US008686987B2

(12) United States Patent
Tsuchi

(10) Patent No.: US 8,686,987 B2
(45) Date of Patent: Apr. 1, 2014

(54) OUTPUT CIRCUIT, DATA DRIVER AND DISPLAY DEVICE

(75) Inventor: Hiroshi Tsuchi, Kanagawa (JP)

(73) Assignee: Renesas Electronics Corporation, Kanagawa (JP)

( * ) Notice: Subject to any disclaimer, the term of this patent is extended or adjusted under 35 U.S.C. 154(b) by 381 days.

(21) Appl. No.: 13/029,888

(22) Filed: Feb. 17, 2011

(65) Prior Publication Data

US 2011/0199366 A1 Aug. 18, 2011

(30) Foreign Application Priority Data

Feb. 18, 2010 (JP) ..... 2010-033497

(51) Int. Cl.
*G09G 5/00* (2006.01)
*G09G 3/36* (2006.01)

(52) U.S. Cl.
USPC ..... 345/212; 345/87; 345/204; 345/211

(58) Field of Classification Search
USPC ..... 345/87, 204, 211, 212
See application file for complete search history.

(56) References Cited

U.S. PATENT DOCUMENTS

| | | | | |
|---|---|---|---|---|
| 5,311,145 | A * | 5/1994 | Huijsing et al. | 330/255 |
| 7,573,333 | B2 * | 8/2009 | Yokota | 330/255 |
| 8,237,697 | B2 * | 8/2012 | Song et al. | 345/211 |
| 2006/0028274 | A1 | 2/2006 | Ishii et al. | |
| 2007/0176913 | A1 * | 8/2007 | Satou | 345/204 |
| 2007/0241817 | A1 * | 10/2007 | Yokota | 330/255 |
| 2009/0212828 | A1 | 8/2009 | Koji | |
| 2009/0244056 | A1 | 10/2009 | Tsuchi | |
| 2011/0025654 | A1 * | 2/2011 | Nishimura et al. | 345/204 |

FOREIGN PATENT DOCUMENTS

| | | | |
|---|---|---|---|
| JP | 06-326529 | A | 11/1994 |
| JP | 2006-050296 | A | 2/2006 |
| JP | 2006-279512 | A | 10/2006 |
| JP | 2007-208316 | A | 8/2007 |
| JP | 2007-281661 | A | 10/2007 |
| JP | 2009-246741 | A | 10/2009 |
| WO | 2006/103977 | A1 | 10/2006 |

OTHER PUBLICATIONS

Japanese Office Action issued Jul. 2, 2013 in corresponding Japanese Patent Application No. 2010-033497.

* cited by examiner

*Primary Examiner* — Amare Mengistu
*Assistant Examiner* — Jennifer Zubajlo
(74) *Attorney, Agent, or Firm* — Sughrue Mion, PLLC

(57) ABSTRACT

Disclosed is an output circuit including a differential amplifier stage, an output amplifier stage, an amplification acceleration circuit and a capacitance connection control circuit. The output amplifier stage includes push/pull type transistors connected an output terminal. The amplification acceleration circuit includes a first switch and a first transistor, connected between a first output of the differential amplifier stage and the output terminal, and a second transistor and a second switch connected between the output terminal and a second output of the differential amplifier stage. The capacitance connection control circuit includes first capacitive element having first end connected to the output terminal, a first switch connected between a second end of the first capacitive element and a first voltage supply terminal, and a second switch connected between the second end of the first capacitive element and one output of a first differential pair of the differential amplifier stage.

20 Claims, 20 Drawing Sheets

OUTPUT CIRCUIT, DATA DRIVER AND DISPLAY DEVICE

REFERENCE TO RELATED APPLICATION

This application is based upon and claims the benefit of the priority of Japanese patent application No. 2010-033497 filed on Feb. 18, 2010, the disclosure of which is incorporated herein in their entirety by reference thereto.

This invention relates to an output circuit that drives a wiring load, and a driver circuit as well as a display device that make use of the output circuit.

TECHNICAL FIELD

Background

In these days, a liquid crystal display device (LCD), featured by thin thickness, light weight and low power consumption, has become widespread as a display device. It has preferentially been used as a display device for mobile equipment, such as mobile phone or cellular phone, a PDA (personal digital assistance) or a notebook computer. More recently, the technique for coping with a large sized liquid crystal display device or with a moving picture has made progress such that it has now become possible to implement a large sized screen display device or a large sized liquid crystal television receiver of a desktop-type. A display device of the active matrix driving system, exploiting an organic light emitting diode (OLED) display, is being developed as a thin type display device.

A typical structure of a thin-type display device (liquid crystal display device and an organic light emitting diode display device) of the active matrix driving system will be briefly described with reference to FIGS. 15A to 15C. FIG. 15A is a block diagram showing essential portions of a display device of a thin thickness. FIG. 15B is a diagram showing a structure of an essential portion of a unit pixel of a display panel of a liquid crystal display device, and FIG. 15C is a diagram showing a structure of an essential portion of a unit pixel of a display panel of an organic light emitting diode display device. The unit pixel in each of FIGS. 15B and 15C is shown as a schematic equivalent circuit.

Referring to FIG. 15A, a thin-type display device of the active matrix driving system includes a power supply circuit 940, a display controller 950, a display panel 960, a gate driver 970 and a data driver 980. The display panel 960 includes a plurality of unit pixels arranged in a matrix array. The unit pixel includes a pixel switch 964 and a display element 963. In a color SXGA panel, for example, the display panel is composed of a matrix array of 1280×3 pixel columns by 1024 pixel rows. The unit pixels are arranged at intersections of scan lines 961 and data lines 962 which are wired in a lattice shape. The scan signals output from the gate driver 970 are transmitted on the scan lines 961 to the unit pixels, and gray scale voltage signals from the data driver 980 are transmitted on the data lines 962 to the unit pixels. The gate driver 970 and the data driver 980 are controlled by a display controller 950, which display controller 950 delivers clocks CLK or control signals as necessary. Image data are supplied in the form of a digital signal to the data driver 980. A power supply circuit 940 supplies power supplies to the gate driver 970 and the data driver 980. The display panel 960 is constituted by a semiconductor substrate. In particular, in a large screen display device, such a semiconductor substrate in which pixel switches are composed by thin film transistors (TFTs) formed on an insulation substrate, such as a glass substrate or a plastics substrate, is in widespread use.

In the above display device, the pixel switches 964 are turned on or off under control by the scan signals. When the pixel switches 964 are turned on, gray scale voltage signals, associated with the image data, are applied to the display elements 963, which are changed in luminance in response to the gray scale to display an image.

Image data for one screen is rewritten in one frame period, which is usually about 0.017 sec in 60 Hz driving. Each scan line 961 is sequentially selected, viz., each pixel switch 964 is turned on, for every pixel row, that is, from line to line. During each period of selection, the gray scale voltage signal is delivered on each data line 962 via the pixel switch 964 to the display element 963. There are also cases where the scan line simultaneously selects a plurality of pixel rows or where a frame frequency greater than or equal to 60 Hz is used.

The case of a liquid crystal display device will now be described with reference to FIGS. 15A and 15B. A display panel 960 is made up of a semiconductor substrate, an opposite substrate and a liquid crystal sandwiched between the two substrates. The semiconductor substrate includes a matrix array of transparent pixel electrodes 973 and pixel switches 964, as unit pixels, arranged in a matrix. The opposite electrode includes a single transparent electrode 974 formed over the entire substrate surface. The display element 963, forming a unit pixel, includes a pixel electrode 973, an opposite substrate electrode 974, a liquid crystal capacitance 971 and an auxiliary capacitance 972.

When the pixel switch 964 is turned on (conductive) by the scan signal from the scan lines 961, a gray scale voltage signal from data line 962 is applied to the pixel electrode 973. The transmittance of the backlight, passing through the liquid crystal under the potential difference between each pixel electrode 973 and the opposite substrate electrode 974 is changed. The potential difference, thus changed, is held for a preset time by the liquid crystal capacitance 971 and the auxiliary capacitance 972, even after the pixel switch 964 is turned off (non-conductive), thereby maintaining a display.

In driving the liquid crystal display device, such driving in which, in order to prevent deterioration of the liquid crystal, the voltage applied to a pixel in its entirety is switched in polarity (positive or negative), the usually for each frame period, with reference to the common voltage of the opposite substrate electrode 974, is used by way of performing the inverting driving. For this reason, the data lines 962 is also driven by the dot inverting driving in which the voltage is changed in polarity from pixel to pixel or by the column inverting driving in which the voltage is changed in polarity from frame to frame.

The case of an organic light emitting diode display device will now be described with reference to FIGS. 15A and 15C. A display panel 960 is constituted by a semiconductor substrate including a matrix array of a large number of unit pixels. Each unit pixel includes a pixel switch 964, an organic light emitting diode 982 and a thin film transistor (TFT) 981 that controls the current supplied to the organic light emitting diode 982. The organic light emitting diode is constituted by an organic film and two thin film electrode layers arranged on both sides of the organic film. The TFT 981 and the organic light emitting diode 982 are connected in series between electrode terminals 984 and 985 supplied with different voltages. Each unit pixel further includes an auxiliary capacitance 983 that holds the control terminal voltage of the TFT 981. It is noted that the display elements 963 that forms a single pixel is made up of the TFT 981, organic light emitting diode 982, electrode terminals 984, and 985, and the auxiliary capacitance 983.

When the pixel switches 964 is turned on (rendered conductive) by the scan signal from the scan line 961, the gray scale voltage signal from the data line 962 is applied to the control terminal of the TFT 981. The current corresponding to the gray scale voltage signal is supplied from the TFT 981 to the organic light emitting diode 982. The organic light emitting diode 982 emits light to a brightness corresponding to the current to provide for the display state. Even after the pixel switch 964 is turned off (rendered non-conductive), the gray scale voltage signal, applied to the control terminal of the TFT 981, is kept for a certain time by the auxiliary capacitance 983 to maintain the light emitting state. Although the pixel switch 964 and the TFT 981, shown here to be N-channel transistors, may also be constituted by P-channel transistors. The organic EL element may also be connected to the side the electrode terminal 984. In driving the organic light emitting diode display device, the inverting driving, such as used in the liquid crystal display device, is unnecessary.

Apart from the above described configuration in which display is made in accordance with a gray scale voltage signal from the data line 962, the organic light emitting diode display device may receive a gray scale current signal output from the data driver. According to the present invention, only the display device that performs display in response to the gray scale voltage signal, output from the data driver, will be described.

Referring to FIG. 15A, the gate driver 970 is required to supply at least a binary scan signal. However, the data driver 980 is required to drive each data line 962 with a multi-level gray scale voltage signal corresponding to the number of the gray scales. For this reason, the data driver 980 includes an output circuit that amplifies the gray scale voltage signal corresponding to the image data to output the resulting amplified signal to the data line 962.

In mobile equipment, notebook personal computers, monitors or TV receivers, having thin-type display devices for high-end use, there are increasing needs in these days for higher picture quality. Specifically, there is being raised a demand for multi-color picture of not less than eight bits or each of R, G and B (ca. 16,800,000 colors), for improving the properties of moving pictures or for a frame frequency (driving frequency in re-writing a picture frame) of 120 Hz in order to cope with a 3D display. It is noted that, if the frame frequency is increased by a factor of N, the 1-data output period is reduced approximately to 1/N.

A data driver of a display device is required for a data driver to output a voltage with extremely high accuracy to cope with the multi-color display as well as to drive data lines at an extremely high speed. An output circuit of the data driver 980 is thus required to possess an extremely high capability to charge/discharge data line capacitances at an extremely high speed. However, if the current consumption of the output circuit is increased in keeping with the increasing demand for this high driving capability of the driving circuit, there is newly presented a problem that a power consumption and a heat generation increase.

As a technique of high-speed driving of data lines of a display device, the following technique has been disclosed.

Referring to FIG. 16 which corresponds to FIG. 1 of Patent Document 1 (JP Patent Kokai JP-A-2007-208316), there is provided a control circuit 90 that detects (93) the input/output potential difference, when an input changes, to turn on output stages (81 and 82) as well as to increase a current supplied to a differential input stage (50) to increase the slew rate (change in the variation of an output voltage per unit time). There is also provided an output assistance circuit (100) that suppresses the shoot-through current of an output stage 80. A control circuit 90 includes an Nch transistor 93-1 and a Pch transistor 93-2 having gates connected in common to an input terminal IN and having sources connected in common to an output terminal OUT. The control circuit 90 also includes a current source 91 connected between a drain of the transistor 93-1 and a power supply VDD, and a current source 92 connected between a drain of the transistor 93-2 and a power supply VSS. The control circuit 90 further includes a Pch transistor 94-7 connected between the gate of the output stage Pch transistor 81 and the output terminal OUT and having a gate connected to a connection node N15 at which the drain of an Nch transistor 93-1 and the current source 91 are connected. The control circuit 90 includes an Nch transistor 94-8 connected between the gate of the output stage N-channel transistor 82 and the output terminal OUT and having the gate connected to a connection node N16 between the drain of a Pch transistor 93-2 and the current source 92.

The differential input stage (50) includes a current source 51 that drives a differential pair (61, 62), an auxiliary current source 53 connected in parallel to the current source 51, a Pch transistor 65, a current source 52 that drives an Nch differential pair (63, 64), an auxiliary current source 54 connected in parallel to the current source 52, and an Nch transistor 66.

When the voltage at the input terminal IN is equal to that at the output terminal OUT, the transistors 93-1, 93-2, 94-7 and 94-8 are turned off. When the voltage at the input terminal IN is changed appreciably towards e.g., the VDD side with respect to the voltage at the output terminal OUT, the transistor 93-1 is turned on and the voltage at the gate of the transistor 94-7 (node N15) is lowered to the voltage at the output terminal OUT. This causes the transistor 94-7 to be turned on and the gate voltage of the output stage transistor 81 is lowered. The output stage transistor 81 is turned on to quickly charge the output terminal OUT to cause the voltage at the output terminal OUT to approach to the voltage at the input terminal IN.

When the gate of the transistor 94-7 (node N15) is lowered, the transistor 65 of the differential input stage 50 is turned on. The current source 53 assists the current source 51 in driving the Pch differential pair (61, 62) to accelerate charging/discharging of the capacitance 84.

When the voltage at the output terminal OUT approaches to the voltage at the input terminal IN, the transistors 93-1 is turned off, and the transistor 94-7 is then turned off. The charging of the output terminal OUT automatically ceases. The voltage at the node N15 becomes equal to that of the power supply VDD to turn off the transistor 65 of the differential input stage 50.

It is noted that, when the voltage at the input terminal IN is changed towards the VDD side, the transistors 93-2, 94-8 and 66 are turned off.

On the other hand, when the voltage at the input terminal IN is changed appreciably towards the VSS side, the transistors 93-2, 94-8 and 82 are turned on to quickly discharge the voltage at the output terminal OUT to cause the voltage to approach to that at the input terminal IN. This discharge operation then ceases automatically. During the time the transistor 93-2 is in operation, the transistor 66 of the differential input stage 50 is turned on to increase the driving current of the Nch differential pair (63, 64) to accelerate charging/discharging of the capacitance 83. At this time, both the transistors 93-1, 94-7 and 65 are all turned off.

When the voltage at the input terminal IN is appreciably changed relative to that at the output terminal OUT, the control circuit 90 is in operation to cause the voltage at the output terminal OUT to quickly approach to that at the input terminal IN. On the other hand, the auxiliary current sources 53 and 54 of the differential input stage 50 are connected to respective differential pairs, in response to the operation of the control circuit 90 to accelerate charging/discharging of the capacitances 83 and 84. This enables high-speed driving of the voltage at the output terminal OUT to a voltage following the change in the voltage at the input terminal IN.

In the output stage 80, phase compensation capacitances 83 and 84 are connected between the gates and the drains (output terminal OUT) of the output stage transistors 81 and 82, respectively. The capacitances of the phase compensation capacitances 83 and 84 are sufficiently larger than the parasitic capacitance of the element.

There is a problem that, when the voltage at the output terminal OUT is suddenly changed, a large shoot-through current (short circuit current) flows through the output stage 80 due to capacitive coupling of the capacitances 83 or 84 (problem of the related technology).

When the gate voltage of the Pch transistor 81 of the output stage is lowered, the voltage at the output terminal OUT is quickly changed towards the VDD side. The potential at the gate terminal of the Nch transistor 82 is then increased due to capacitive coupling of the capacitance 84, thus increasing a gate-to-source voltage of the output stage Nch transistor 82. The shoot-through current then flows between the power supplies VDD and VSS.

When the gate voltage of the Nch transistor 82 of the output stage is pulled up, the voltage at the output terminal OUT is quickly changed towards the VSS side. The potential on the gate terminal of the Pch transistor 81 is then decreased due to capacitive coupling of the capacitance 83, thus increasing the gate-to-source voltage of the output stage Pch transistor 81. The shoot-through current then flows between the power supplies VDD and VSS.

In order to prevent the occurrence of a shoot-through current, there is provided an output assistance circuit 100 that is operated in response to changes in the gate voltages of the output stage transistors 81 and 82, as shown in FIG. 16.

For example, when the voltage at the input terminal IN is changed appreciably towards the VDD side with respect to the voltage at the output terminal OUT, the control circuit 90 is in operation to pull down the gate potential of the output stage Pch transistor 81. This causes the voltage at the output terminal OUT to approach quickly to the voltage at the input terminal IN.

With the increase of the voltage at the output terminal OUT, the gate voltage of the output stage transistor 82 is increased by capacitive coupling of the capacitance 84.

Assuming that the output assistance circuit 100 is not provided, the gate voltage of the output stage transistor 82 rises appreciably, a large shoot-through current from the power supply VDD to the power supply VSS is produced in the output stage 80.

Contrary to this, with the output assistance circuit 100 being provided, when the gate potential of the output stage transistor 81 is lowered, a Pch transistor 111 of the output assistance circuit 100 is turned on to pull up the gate potential of an Nch transistor 115. As a result, the Nch transistor 115 is turned on. The Nch transistor 115 has a drain connected to the gate of the output stage transistor 82 and has a source connected to VSS via an N-channel transistor 116, which is a diode-connected. This results in suppressing a rise of the gate potential of the output stage transistor 82. Thus, the shoot-through current in the output stage 80 is suppressed.

When the voltage at the input terminal IN is changed appreciably towards the VSS side, the Nch transistor 112 of the output assistance circuit 100 is turned on and the gate potential of a Pch transistor 114 is lowered. As a result, the Pch transistor 114 is turned on. The Pch transistor 114 has a drain connected to the gate of the output stage transistor 81 and has a source connected to VDD via an N-channel transistor 113 which is diode-connected. This suppresses a lowering of the gate potential of the output stage transistor 81, caused by capacitive coupling of the capacitance 83. As a result, the shoot-through current in the output stage 80 is suppressed.

The output assistance circuit 100 also includes transistor switches 65-9 and 66-10 that activate the auxiliary current sources 53 and 54 of the differential input stage 50, in case the gate voltages of the output stage transistors 81 and 82 are changed, respectively. When the auxiliary current sources 53 or 54 are activated, charging/discharging of the capacitances 83 or 84 is accelerated.

FIG. 1 of Patent Document 2 (JP Patent Kokai Publication No. JP-P2007-281661A) is here shown as FIG. 17 without any changes. Thus, FIG. 17 shows the configuration of an amplifier circuit that drives the data line of a liquid crystal display device. In the amplifier circuit having a configuration in which a phase compensation capacitance is fixedly connected between gates and drains (output terminals) of Pch and Nch transistors of a push-pull output stage, a shoot-through current is generated due to capacitive coupling. For this reason, the destination of connection of a second terminal of each of two capacitances (31, 32), which have first terminals connected to an output terminal of a push-pull output stage (Pch transistor 14 and Nch transistor 15), is changed over to the gates of the output stage transistors or to the power supplies in accordance with change/no change in polarity from a preceding output period and switching in the output period, thereby suppressing the shoot-through current.

Reference is made to the timing chart of FIG. 5 of Patent Document 2, according to which:

When charging from a negative polarity to a positive polarity, the second terminal of a capacitance 31 is connected to the gate of an output stage transistor 14, while the second terminal of the capacitance 32 is connected to GND;

When discharging from a positive polarity to a negative polarity, the second terminal of the capacitance 31 is connected to VDD, while the second terminal of the capacitance 32 is connected to the gate of the output stage transistor 15;

When the polarity is unchanged, the second terminals of the capacitances 31 and 32 are connected to the gates of the output stage transistors 14 and 15, respectively; and the connection the second terminals of the capacitances 31 and 32 are kept unchanged in one output period.

This prevents a shoot-through current from flowing through the output stage when an output voltage of the output stage changes.

FIG. 18 corresponds to FIG. 1 of Patent Document 3 (JP Patent Kokai Publication No. JP-A-06-326529), and shows a configuration of a voltage follower in which an output terminal of a differential amplifier of FIG. 1 of Patent Document 3 is feed-backed to its inverting input terminal. This voltage follower will now be described as the related technique. Referring to FIG. 18, showing an differential amplifier stage, output pair of an Nch differential pair (111, 112), which is driven by a current source 113, are connected to a connection node of transistors 131 and 133 and to a connection node of transistors 132 and 134 (node 7) of a Pch low-voltage cascode current mirror (131 to 134). Pair outputs of a Pch differential pair (121, 122), which is driven by a current source 123, are connected to a connection node of transistors 141 and 143 and a connection node of transistors 142 and 144 (node 8) of an Nch low voltage cascode current mirror (141 to 144). Between the Pch and Nch low voltage cascode current mirrors there are provided a floating current source 151, and floating current sources (152 and 153). The floating current source 151 is connected between the drains of the transistors 133 and 143. Floating current sources (152, 153) are connected between the drains of the transistors 134 and 144.

In an output amplifier stage, a Pch transistor 101, which is connected between a power supply E1 and an output terminal 2, has a gate connected to a drain of the transistor 134 (node 3), and a Nch transistor 102, which connected between a power supply E2 and the output terminal 2, has a gate connected to a drain of the transistor 144. The transistors 101 and 102 constitute a push-pull output stage.

First terminals of phase compensation capacitors C1 and C2 are connected in common to the output terminal 2. A second terminal of the phase compensation capacitors C1 is connected to a connection node (node 7) of the transistors 132 and 134. A second terminal of the phase compensation capacitors C2 is connected to a connection node (node 8) of the transistors 142 and 144.

The operation of the differential amplifier stage shown in FIG. 18 will now be described. In FIG. 18, currents of the current sources 113 and 123 in the stable output state are designated as I1 and I2, respectively. The current of the floating current source 151 is designated as I3, and the sum of the currents of the floating current sources (152, 153) is designated as I4. The input voltage VI is assumed to be a step voltage.

When, for example, the input voltage VI of the input terminal 1 is changed appreciably towards the power supply E1 with respect to the output voltage VO at the output terminal 2, the transistors 111 and 112 of the Nch differential pair are turned off and on, respectively. The current I1 of the current source 113 flows in the transistor 112.

The current through the transistor 111 and the current I3 of the current source 151, combined together, flows through the transistor 131 of the Pch low voltage cascode current mirror. However, since the transistor 111 is off, the mirror current of the current I3 flows through the transistor 132. The current flowing through the transistor 132 at this time is smaller than that in an output stable state. The current flowing through the transistor 112 becomes larger than that in the output stable state.

Hence, the voltage at the connection node (node 7) of the transistors 132 and 134 is slightly decreased and the gate-to-source voltage of the transistor 134 (absolute value) is decreased. The current supplied from the transistor 134 to the floating current source (152, 153) is decreased.

On the other hand, when the input voltage VI is changed appreciably towards the side the power supply E1, the transistors 121 and 122 of the Pch differential pair are turned on and off, respectively. The current I2 of the current source 123 flows through the transistor 121.

As regards the transistor 141 of the low voltage cascode current mirror, since a mirror current of the total current in the transistor 121 and the current source 151 flows through the transistor 142, the mirror current of the current (I2+I3) flows through the transistor 142.

At this time, the current flowing through the transistor 142 is larger than that during the output stable state, and the current flowing through the transistor 122 is smaller than the current in the output stable state. The voltage at the connection node (node 8) of the transistors 142 and 144 thus becomes slightly lower. The gate-to-source voltage of the transistor 144 becomes larger so that a sink current by the transistor 144 flowing from the floating current source (152, 153) increases.

Since the currents flowing in the transistors 134 and 144 are decreased and increased, respectively, the gate-to-source voltage (absolute value) of the transistor 152 of the floating current source becomes smaller, while the gate-to-source voltage of the transistor 153 becomes larger. Hence, the gate voltage of the output stage transistor 101 is decreased appreciably. As a result, the output stage transistor 101 increases the charging current from the power supply E1 to the output terminal 2. On the other hand, since the gate voltage of the output stage transistor 102 is decreased, the discharge current flowing from the output terminal 2 to the power supply E2 via the output stage transistor 102 is decreased. Hence, the output voltage VO at the output terminal 2 rises. The output stable state is set when the output voltage VO has reached the input voltage VI. It is noted that, during the operation in which one of the pair transistors that form a differential pair is on, with the other being off, the output voltage VO is varied at a constant slew rate.

The time change rate of the output voltage VO may be expressed in terms of the currents contributing to charging/discharging of the phase compensation capacitors C1 and C2. When the input voltage VI has changed appreciably towards the power supply E1, as described above, the potential difference in the capacitance C1 is decreased. This operation is determined by the combined current: (I1−I3+I4') of the transistors 132, 134 and 112 which contribute to discharging of the capacitance C1. The time change rate of the output voltage VO (dVO/dt) may be approximated by the following expression (1):

$$dVO/dt \approx (I1-I3+I4')/C1 \quad (1)$$

where the current I4' is a sum current of the floating current sources (152, 153) changed from the current I4 in the output stable state due to current change in the transistor 134. It is noted that, when the input voltage VI is changed towards the power supply E1, the potential difference at the capacitance C2 is increased.

This operation is determined by the combined current: (I2+I3−I4') of the transistors 142, 144 and 122 which contribute to charging of the capacitance C2. The time change rate of the output voltage VO (dVO/dt) may be approximated by the following expression:

$$dVO/dt \approx (I2+I3-I4')/C2 \quad (2)$$

From the expressions (1) and (2), the currents I3 and I4' are eliminated. Solving with respect to time change rate (dVO/dt) of the output voltage VO, the following expression (3) is derived.

$$dVO/dt \approx (I1+I2)/(C1+C2) \quad (3)$$

The slew rate of the output voltage VO is changed at a constant slew rate determined by the currents I1 and I2 of the current sources (113 and 123) which supply currents to the Nch differential pair (111, 112) and the Pch differential pair (121, 122), respectively, and the phase compensation capacitors C1 and C2.

The description of the detailed operation in case the input voltage VI at the input terminal 1 is changed appreciably towards the power supply E2 with respect to the output voltage VO is dispensed with. However, such operation will be readily understood from the above described operation in which the input voltage VI is changed towards the power supply E1.

The connection node (node 7) of the transistors 132 and 134, to which the capacitance C1 and one of output pair of the Nch differential pair (drain of transistor 112) are connected, is subjected to a potential variation which is enough to just change the gate-to-source voltage of the transistor 134. However, the lower limit voltage of the potential variation is limited by the gate bias voltage (BP1) of the transistor 134. Thus, the operating point of the node 7 is kept in the vicinity of a voltage slightly lower than the power supply E1 at all times.

In similar manner, the junction (node 8) of the transistors 142 and 144, to which the capacitance C2 and one of output pair of the Nch differential pair (drain of transistor 122) are connected in common, is subjected to a potential variation that is enough to just change the gate-to-source voltage of the transistor 144. However, the upper limit voltage of the potential variation is limited by the gate bias voltage (BN1) of the transistor 144. Hence, the operating point of the node 8 is kept at all times in the vicinity of a voltage slightly higher than the power supply E2.

It is noted that, when the input voltage VI is changed towards the power supply E1, the current is pulled from the Nch transistor 153 of the floating current source. Thus, the drain of the transistor 134 (node 3), to which the gate of the output stage transistor 101 is connected, may be changed to a sufficiently low voltage. Hence, the output stage transistor 101 is able to charge the output terminal 2 speedily by its high current driving capability.

In similar manner, when the input voltage VI is changed towards the power supply E2, the current is supplied from the Pch transistor 152 of the floating current source. The drain of the transistor 144 (node 4), to which the gate of the output stage transistor 102 is connected, may thus be changed to a sufficiently high voltage. Hence, the output stage transistor 102 is able to discharge the output terminal 2 speedily by its high current driving capability.

[Patent Document 1] JP Patent Kokai Publication No. JP-P2007-208316A

[Patent Document 2] JP Patent Kokai Publication No. JP-P2007-281661A

[Patent Document 3] JP Patent Kokai Publication No. JP-A-06-326529

SUMMARY

The following is an analysis of the related technologies.

The above described related technologies suffer from various deficiencies, as discussed above. For example, in the configuration shown in FIG. 16, the shoot-through current in the output stage may be suppressed to provide for a high slew rate by addition of the control circuit 90, auxiliary current sources 53 and 54, and the output assistance circuit 100. However, a large number of transistors must be added, resulting in increased area and cost. In addition, the auxiliary current sources 53 and 54 of the differential input stage 50 are set into operation to accelerate the charging/discharging of the capacitances 83 and 84. However, the high speed charge/discharge of the capacitances 83 and 84 to follow rapid voltage changes of the output terminal OUT, needs a sufficient increase in the current values of the auxiliary current sources 53 and 54 and hence current consumption is increased.

In addition, in driving a data line of the liquid crystal display device, the circuit of FIG. 17 is not able to suppress the shoot-through current against change in the output voltage in which the same polarities occur in succession as in column inverting driving. It is because the second terminals of the capacitances 31 and 32 are respectively connected to the gates of the output stages 14 and 15. In the driving of the data lines of the organic light emitting diode display device, since there are no polarity signal, it is not possible to suppress the shoot-through current against a large change in the output voltage.

In the circuit of FIG. 18, the change in the output voltage is determined by the currents I1 and I2 driving the differential pair and by the phase compensation capacitors C1 and C2. Hence, in order to speed up the change in the output voltage, it is necessary to increase the currents I1 and I2 that drive the differential pair, thus increasing the current consumption. The slew rate may be increased by decreasing capacitance values of the phase compensation capacitors C1 and C2. However, the output stability of the circuit is deteriorated, and the circuit may not be realistic.

It is an object of the present invention to provide an output circuit which is adaptable to a high speed operation and is able to suppress a shoot-through current from flowing therethrough, a data driver including the output circuit and a display device. It is another object of the present invention to provide an output circuit which can accomplish the above mentioned object, a data driver including the output circuit, and a display device including the data driver, each of which has a simplified configuration and is able to suppress an increase of current consumption.

The present invention which seeks to solve at least one of the above problems may be summarized as follows, though not limited thereto.

According to the present invention, there is provided an output circuit comprising:

an input terminal supplied with an input signal;

an output terminal that outputs an output signal;

a first power supply terminal supplied with a first power supply voltage;

a second power supply terminal supplied with a second power supply voltage;

a first voltage supply terminal supplied with a first voltage;

a differential amplification stage;

an output amplification stage;

an amplification acceleration circuit; and a capacitance connection control circuit.

The output amplification stage includes:

a first transistor of a first conductivity type having first and second terminals connected to the first power supply terminal and the output terminal, respectively, and having a control terminal connected to a first output of the differential amplifier stage; and a second transistor of a second conductivity type having first and second terminals connected to the second power supply terminal and the output terminal, respectively, and having a control terminal connected to a second output of the differential amplifier stage.

The amplification acceleration circuit includes:

first and second switches;

a third transistor of the second conductivity type connected in series with the first switch between the output terminal and the first output of the differential amplifier stage, the third transistor having a control terminal connected to the input terminal; and a fourth transistor of the first conductivity type connected in series with the second switch between the output terminal and the second output of the differential amplifier stage, the fourth transistor having a control terminal connected to the input terminal.

The differential amplifier stage includes:

first differential pair transistors of the second conductivity type having first terminals coupled together, having second terminals connected to a first node and a second node, respectively, and having control terminals connected to the input terminal and the output terminal, respectively;

a first current source connected between the coupled first terminals of the first differential pair transistors and the second power supply terminal;

first pair transistors of the first conductivity type having first terminals connected in common to the first power supply terminal, having second terminals connected to the first and second nodes, respectively, and having control terminals coupled together;

second pair transistors of the second conductivity type having first terminals connected in common to the second power supply terminal, and having second terminals connected to a third node and a fourth node, respectively, and having control terminals coupled together;

a fifth transistor of the first conductivity type having a first terminal connected to the first node, having a second terminal connected to the first output of the differential amplifier stage, and having a control terminal supplied with a first bias voltage;

a sixth transistor of the second conductivity type having a first terminal connected to the third node, having a second terminal connected to the second output of the differential amplifier stage, and having a control terminal supplied with a second bias voltage;

a first connection circuit connected between the second node and the fourth node; and a second connection circuit connected between the first output and the second output of the differential amplifier stage.

The capacitance connection control circuit includes:

a first capacitive element having a first terminal connected to the output terminal;

a third switch connected between the first voltage supply terminal and a second terminal of the first capacitive element; and a fourth switch connected between the second terminal of the first capacitive element and one of the first and third nodes.

According to the present invention, a high speed operation may be realized and a shoot-through current of an output stage may be suppressed. Moreover, according to the present invention, the configuration may be simplified, and an increase of current consumption may be suppressed.

Still other features and advantages of the present invention will become readily apparent to those skilled in this art from the following detailed description in conjunction with the accompanying drawings wherein only exemplary embodiments of the invention are shown and described, simply by way of illustration of the best mode contemplated of carrying out this invention. As will be realized, the invention is capable of other and different embodiments, and its several details are capable of modifications in various obvious respects, all without departing from the invention. Accordingly, the drawing and description are to be regarded as illustrative in nature, and not as restrictive.

PREFERRED MODES

Figure 1:
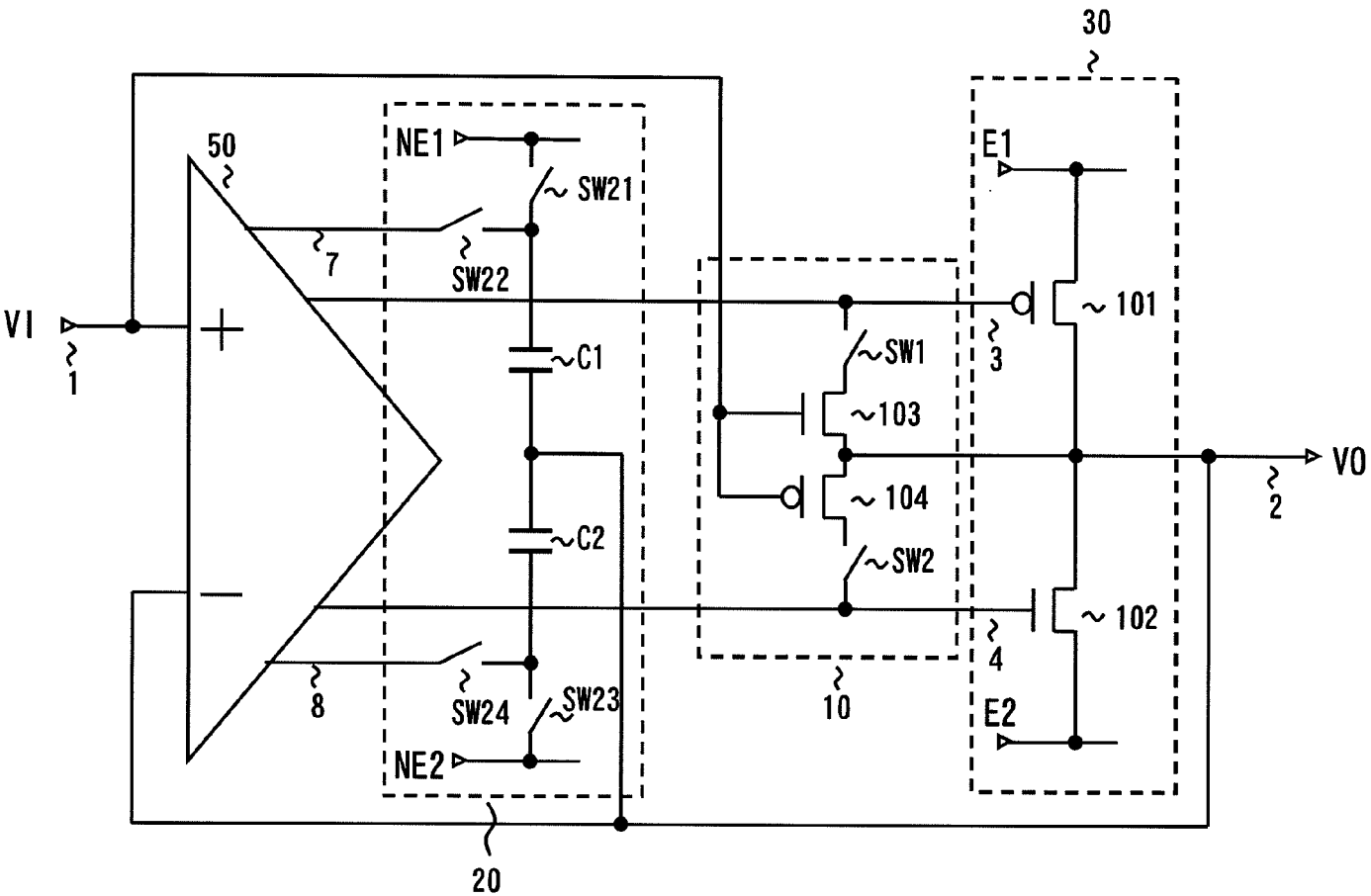
FIG. 1 is a circuit diagram showing a configuration of an exemplary embodiment 1 of the present invention.

Preferred exemplary embodiments of the present invention will now be described with reference to the drawings. In the drawings explained in connection with preferred exemplary embodiments of the present invention, there are reference symbols or numerals that are partially overlapped with those used in connection with the drawings for the related technologies of FIGS. 16 and 17 (for example, 1, 2, 3 and 10 of FIG. 17). Also, if the same reference symbols or numerals which are the same as those used in connection with the drawings of the related technologies, as in FIG. 18, such effect will be described in the corresponding description of the following exemplary embodiments.

In a mode, the present invention includes an input terminal (1) inputting a signal, an output terminal (2) outputting a signal, a differential amplification stage (50), an output amplification stage (30), an amplification acceleration circuit (10), and a capacitance connection control circuit (20).

The output amplification stage (30) includes: a first transistor of a first conductivity (P) type (101) having first and second terminals connected respectively to a first power supply (E1) and to the output terminal and having a control terminal connected to a first output (3) of the differential amplifier stage (50). The output amplification stage also includes a second transistor (102) of a second conductivity (N) type having first and second terminals connected respectively to a second power supply (E2) and to the output terminal (2), and a control terminal connected to a second output (4) of the differential amplifier stage.

The amplification acceleration circuit (10) includes first and second switches (SW1 and, SW2), a third transistor of a second conductivity (N) type (103) which is connected in series with the first switch (SW1) between the output terminal (2) and the first output (3) of the differential amplifier stage (50) and which has a control terminal (gate terminal) connected to the input terminal (1); and a fourth transistor (104) of a first conductivity type (N) which is connected in series with the second switch (SW2) between the output terminal (2) and the second output (4) of the differential amplifier stage (50) and which has a control terminal (gate terminal) connected to the input terminal (1).

The differential amplifier stage (50) includes:

first differential pair transistors (for example, 112 and 111 of FIG. 9) having respective gates connected in common to the input terminal (1) and to the output terminal (2), respectably;

a first current source (for example, 113 of FIG. 9) that supplies a current to the first differential pair transistors;

first pair transistors of a first conductivity type (132 and 131), which have first terminals (source terminals) connected in common to the first power supply (E1), second terminals (drain terminals) connected via first and second nodes (N1 and N2) to an output pair of the first differential pair transistors (112 and 111) of the first conductivity type, and control terminals connected together;

second pair transistors of a second conductivity type (142 and 141) which have first terminals (source terminals) connected in common to the second power supply (E2), second terminals (drain terminals) connected to third and fourth nodes (N3, N4), and control terminals connected in common;

a fifth transistor of the first conductivity type (134) which has a first terminal (source terminal) connected to the first node (N1), a second terminal (drain terminal) connected to the first output (3) of the differential amplifier stage (50) and a control terminal (gate terminal) supplied with a first bias voltage;

a sixth transistor of a second conductivity type (144) which has a first terminal (source terminal) connected to the third node (N3), a second terminal (drain terminal) connected to the second output (4) of the differential amplifier stage (50) and a control terminal (gate terminal) receiving a second bias voltage;

a first connection circuit (e.g., 60L of FIG. 9) connected between the second and fourth nodes (N2, N4), and a second connection circuit (e.g., 60R of FIG. 9) connected between the first and second outputs (3, 4) of the differential amplifier stage (50).

Figure 9:
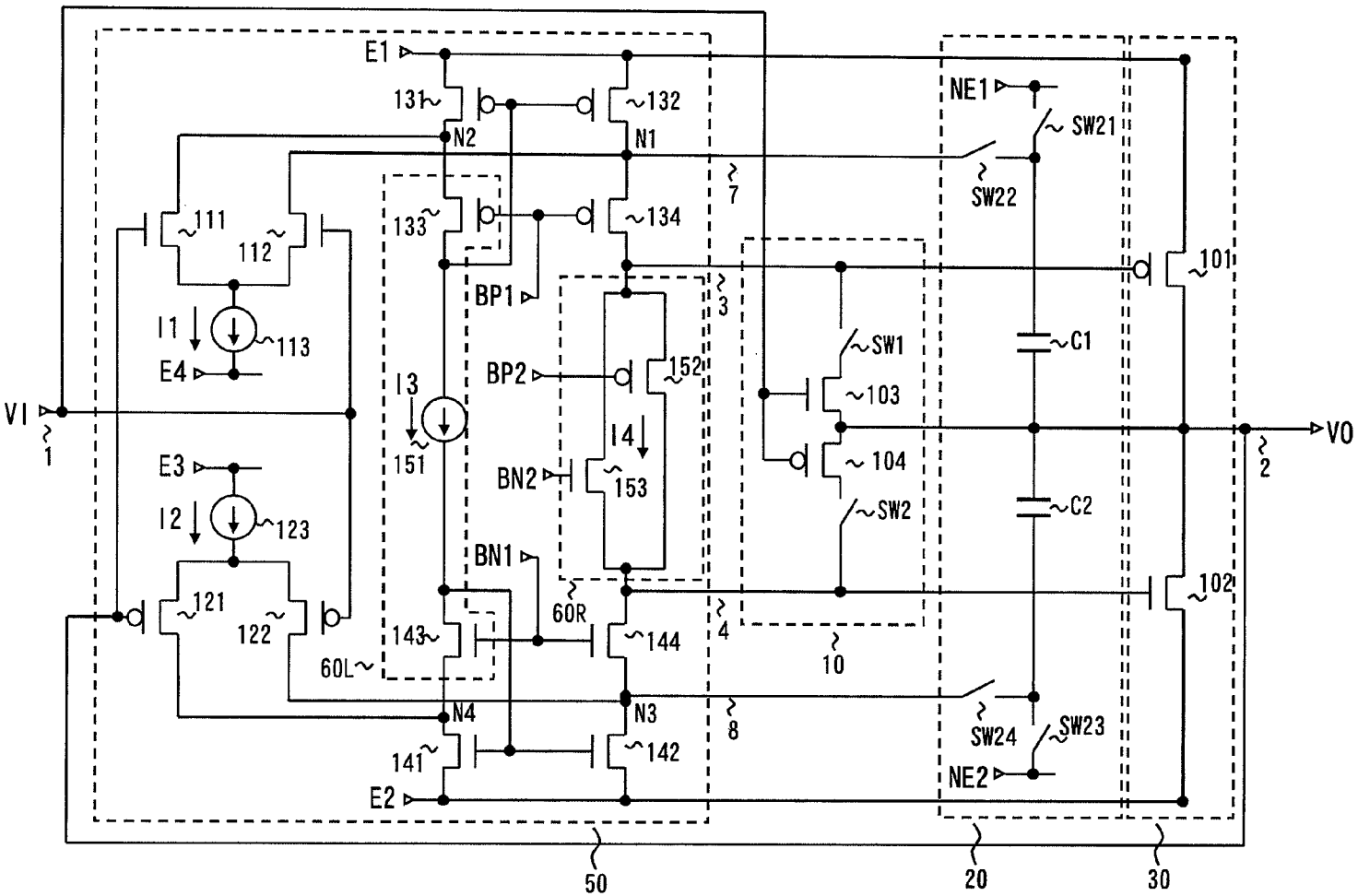
FIG. 9 is a circuit diagram showing a configuration of Example 1 of the present invention

According to the present invention, the capacitance connection control circuit (20) includes a first capacitive element (e.g., C1 of FIG. 9) having a first terminal connected to the output terminal (2), a third switch (e.g., SW21 of FIG. 9) connected between a first voltage supply terminal (e.g., NE1 of FIG. 9) and a second terminal of the first capacitive element (e.g., C1 of FIG. 9), and a fourth switch (e.g., SW2 of FIG. 9) connected between the second terminal of the first capacitive element (e.g., C1 of FIG. 9) and one of the first and third nodes (e.g., N1 (node 7) of FIG. 9).

In the present exemplary embodiment, the differential amplifier stage (50) may further include second differential pair transistors (e.g., 122 and 121 of FIG. 9) having the above mentioned input terminal (1) and the above mentioned output terminal (2). The first differential pair transistors (e.g., 112 and 111 of FIG. 9) are of the second conductivity type (N type) and the second differential pair transistors (e.g., 122 and 121 of FIG. 9) are of the first conductivity type (P type).

The capacitance connection control circuit (20) may further include a second capacitance element (e.g., C2 of FIG. 9) having a first terminal connected to the above mentioned output terminal (2);

a fifth switch (e.g., SW23 of FIG. 9) connected between the second terminal of the above mentioned second capacitance element (e.g., C2 of FIG. 9) and a second voltage supply terminal (NE2 of FIG. 9);

a sixth switch (e.g., SW24 of FIG. 9) connected between the second terminal of the second capacitance element (e.g., C2 of FIG. 9) and the other of the first and third nodes (e.g., N3 (node 8)). Several exemplary embodiments and also several more concrete Examples will now be described.

Exemplary Embodiment 1

FIG. 1 shows a configuration of an output circuit according to an exemplary embodiment 1 of the present invention. In the present exemplary embodiment, the output circuit preferably drives a wiring load. The circuit includes a differential amplifier stage 50, an output amplifier stage 30, an amplification acceleration circuit 10 and a capacitance connection control circuit 20. The differential amplifier stage 50 differentially receives an input voltage VI at an input terminal 1 and an output voltage VO of an output terminal 2. The output amplifier stage 30 includes a Pch transistor 101 and a Nch transistor 102, which receive first and second outputs (at nodes 3 and 4) of the differential amplifier stage 50 to perform a push-pull operation to output at an output terminal 2 the output voltage VO which is in accordance with the input voltage VI. The amplification acceleration circuit 10 detects the potential difference between the input voltage VI and the output voltage VO to perform accelerated amplification in accordance with the potential difference. The capacitance connection control circuit 20 includes capacitive elements C1 and C2 whose first terminals are connected to the output terminal 2. The capacitance connection control circuit controls the connection of the second terminals of the capacitive elements C1 and C2.

In the output amplifier stage 30, the Pch transistor 101 has a first terminal (source terminal) connected to a power supply E1, has a second terminal (drain terminal) connected to the output terminal 2 and has a gate supplied with a first output of the differential amplifier stage 50 (node 3). The Nch transistor 102 has a first terminal (source terminal) connected to a power supply E2, has a second terminal (drain terminal) connected to the output terminal 2 and has a gate supplied a second output of the differential amplifier stage 50 (node 4).

The amplification acceleration circuit 10 includes an Nch transistor 103 and a Pch transistor 104 which have first terminals (source terminals) connected in common to the output terminal 2 and the gate terminals connected in common to the input terminal 1 and supplied with the input signal VI. The gate terminal of the Pch transistor 101 may be controlled in response to an output current from the second terminal (drain terminal) of the Nch transistor 103 and the gate terminal of the Nch transistor 102 may be controlled in response to an output current from the second terminal (drain terminal) of the Pch transistor 104. There is provided a first switch SW1 between the second terminal (drain terminal) of the Nch transistor 103 and the node 3. The Nch transistor 103 and the switch SW1 are connected in series between the output terminal 2 and the node 3. It is noted that the Nch transistor 103 and the switch SW1 can be exchanged in positions so long as they are connected in series between the output terminal 2 and the node 3.

There is provided a second switch SW2 between the second terminal (drain terminal) of the Pch transistor 104 and the node 4. The Pch transistor 104 and the switch SW2 are connected in series between the output terminal 2 and the node 4. It is noted that the Pch transistor 104 and the switch SW2 can be exchanged in positions so long as they are connected in series between the output terminal 2 and the node 4.

The first and second switches SW1 and SW2, when both are on, activate the transistors 103 and 104 and deactivate the transistors 103 and 104 when both are off. The first and second switches SW1 and SW2 control the activation (operation) and deactivation (suspend operation) of the amplification acceleration circuit 100.

The capacitance connection control circuit 20 includes the first and second capacitive elements C1 and C2 which have first terminals connected to the output terminal 2. The capacitance connection control circuit 20 also includes third and fourth switches SW21 and SW22 that change over the destination of connection of the second terminal of the capacitance element C1 between a first voltage supply terminal NE1 and a node 7 of the differential amplifier stage 50. The first voltage supply terminal NE1 supplies a first voltage.

The capacitance connection control circuit 20 further includes fifth and sixth switches SW23 and SW24 that change over the destination of connection of the second terminal of the capacitance element C2 between a second voltage supply terminal NE2 and a node 8 of the differential amplifier stage 50. The second voltage supply terminal NE2 supplies a second voltage. It is noted that the nodes 7 and 8 differ from the first and second outputs (nodes 3 and 4) of the differential amplifier stage 50 and are terminals subjected to lesser voltage variations than first and second outputs (nodes 3 and 4) of the differential amplifier.

The first and second voltage supply terminal NE1 and NE2 may respectively be power supplies E1 and E2 of the output amplifier stage 30.

The differential amplifier stage 50 may include

Nch differential pair transistors (112 and 111) having first and second inputs connected respectively to an input terminal 1 supplied with the input voltage V1 and to an output terminal 2 supplied with the output voltage VO;

a current source 113 that supplies a current to the Nch differential pair transistors (112 and 111);

Pch pair transistors (132 and 131) connected between output pair of the Nch differential pair transistors (112 and 111) and the power supply E1 and forming a current mirror which receives an input current and outputs a mirror current of the input current;

Nch pair transistors (142 and 141) connected to the power supply E2 and forming a current mirror which receives an input current outputs a mirror current of the input current;

a P-channel transistor 134 that is connected between an output end (drain of 132; node 7) of Pch pair transistors (132 and 131) for outputting the mirror current and the first output (node 3) of the differential amplifier stage 50 and that has a gate terminal (control terminal) supplied with a first bias voltage (BP1); and an Nch transistor 144 that is connected between an output end (drain of 142; node 8) of the Nch pair transistors (142, 141) for outputting the mirror current and a second output (node 4) of the differential amplifier stage 50 and that has a gate (control terminal) supplied with a second bias voltage (BN1). The output end of the Pch pair transistors (132 and 131) is one of connection nodes of the Nch differential pair transistors (112, 111) and the Pch pair transistors (132, 131). The output end of the Nch pair transistors (142 and 141) is one of connection nodes of the Pch differential pair transistors (132, 121) and the Pch pair transistors (142, 141).

In one of modes of the present invention, though not limited thereto, the output end of the Pch pair transistors (132 and 131) is a drain node of Pch transistor 132 (node 7) and the output end of the Nch pair transistors (142 and 141) is a drain node of Nch transistor 142 (node 8).

The differential amplifier stage 50 also includes a first connection circuit (60L) connected between the input end of the Pch pair transistors 131 and 132 (drain of 131) and the input end of the Nch pair transistors 141 and 142 (drain of 141); and a second connection circuit (60R) connected between the first and second outputs (nodes 3 and 4) of the differential amplifier stage.

The differential amplifier stage 50 may include, in place of the Nch differential pair transistors (112 and 111) and the current source 113, Pch differential pair transistors (122 and 121) and a current source 123 that supplies a current to the Pch differential pair transistors (122 and 121).

The Pch differential pair transistors 122 and 121 include first and second inputs, connected respectively to the input terminal 1 and the output terminal 2, and have output pair connected to the Nch pair transistors (141 and 142).

Or, the differential amplifier stage 50 may include Pch differential pair transistors (122 and 121) and the current source 123 in addition to Nch differential pair transistors (112 and 111) and the current source 113, The first output (node 3) and the node 7 of the differential amplifier stage 50 are respectively connected to the first terminal (source terminal) and the second terminal (drain terminal) of the first bias transistor 134.

The second output (node 4) and the node 8 of the differential amplifier stage 50 are respectively connected to the first terminal (source terminal) and the second terminal (drain terminal) of the second bias transistor 144.

In the differential amplifier stage 50, the first and second outputs (nodes 3 and 4), the gates of the output stage transistors (101 and 102) are connected to, and the nodes 7 and 8 are separated from each other. The second terminals of the capacitive elements C1 and C2, which have the first terminals connected in common to the output terminal 2, are connected to the nodes 7 and 8, respectively. Thus, even though the output voltage VO is changed rapidly, a shoot-through current due to capacitive coupling of the capacitive elements C1 and C2, may be prevented from flowing through the output stage transistors 101 and 102.

The operation of the output circuit, shown in FIG. 1, will now be described. In the amplification acceleration circuit 10, shown in FIG. 1, when the input voltage VI at the input terminal 1 is changed appreciably with respect to the output voltage VO at the output terminal 2, the Nch transistor 103 or the Pch transistor 104, having sources connected to the output terminal 2 and having the gates connected to the input terminal 1, causes the gate voltage of the output stage transistor 101 or 102 to be changed with a driving capability in accordance with the potential difference between the input voltage VI and the output voltage VO (gate-to-source voltage of the transistor). The output voltage VO is thus caused quickly to approach to the input voltage VI. This enables high-speed driving of the output terminal 2 without dependency upon the operation of the differential amplifier stage 50.

In the amplification acceleration circuit 10, the sources and the gates of the transistors 103 and 104 are connected to the output terminal 2 and to the input terminal 1, respectively. In case the difference between the input voltage VI and the output voltage VO is less than the threshold voltage (absolute value) of the transistors 103 and 104, the transistors 103 and 104 are turned off. The operation thus ceases automatically when the output voltage VO approaches to the input voltage VI. Similarly, the amplification acceleration circuit 10 is not in operation when the change in the input voltage VI is small. It is noted that the transistors 103 and 104 may be of a sufficiently small size (such as a gate size) to suppress gate parasitic capacitances of the transistors 103 and 104, connected to the input terminal 1, to small values to suppress increase in an input capacitance of the output circuit of FIG. 1 to a smallest value possible.

When the amplification acceleration circuit 10 is in operation, and the output voltage VO is changed rapidly, the second terminals of the capacitive elements C1 and C2 of the capacitance connection control circuit 20 are connected to the voltage supply terminals NE1 and NE2, respectively. This allows accommodating rapid changes in the output voltage VO to charge/discharge the capacitive elements C1 and C2.

In the differential amplifier of the related technology (FIG. 18), the capacitive elements C1 and C2 are charged/discharged under the operation of the differential amplifier stage 50 based on the current from the current source that drives the differential pair. The output voltage is changed with a constant slew rate.

In the present exemplary embodiment, in case the output voltage is changed rapidly, charging/discharging may be achieved instantaneously, not by the operation of the differential amplifier stage 50, but from the voltage supply terminals NE1 and NE2, in accordance with rapid changes in the output voltage VO.

In the capacitance connection control circuit 20, the destination of connection to the second terminals of the capacitive elements C1 and C2 is changed over from the voltage supply terminals NE1 and NE2 to the nodes 7 and 8 of the differential amplifier stage 50, respectively, following the rapid voltage change of the output voltage VO.

This restores the output circuit of FIG. 1 to the intrinsic operation as a differential amplifier in which the capacitive elements C1 and C2 are charged/discharged or the output stage transistors 101 and 102 is into operation in response to the operation of the differential amplifier stage 50.

Until this connection switching time in which the destination of connection of the second terminals of the capacitive elements C1 and C2 is changed over from the voltage supply terminals NE1 and NE2 to the nodes 7 and 8 of the differential amplifier stage 50, the capacitive elements C1 and C2 are charged/discharged to follow a rapid change in the output voltage VO. Thus, after switching to the nodes 7 and 8 as the destination of the connection of the second terminals of the capacitive elements C1 and C2, the operation of the output circuit shifts quickly to the operation of a commonly used differential amplifier which is driven by a current from the current source that drives the differential pair transistors. As a result, the output terminal 2 can be rapidly driven to a voltage in accordance with the input voltage VI.

Figure 16:
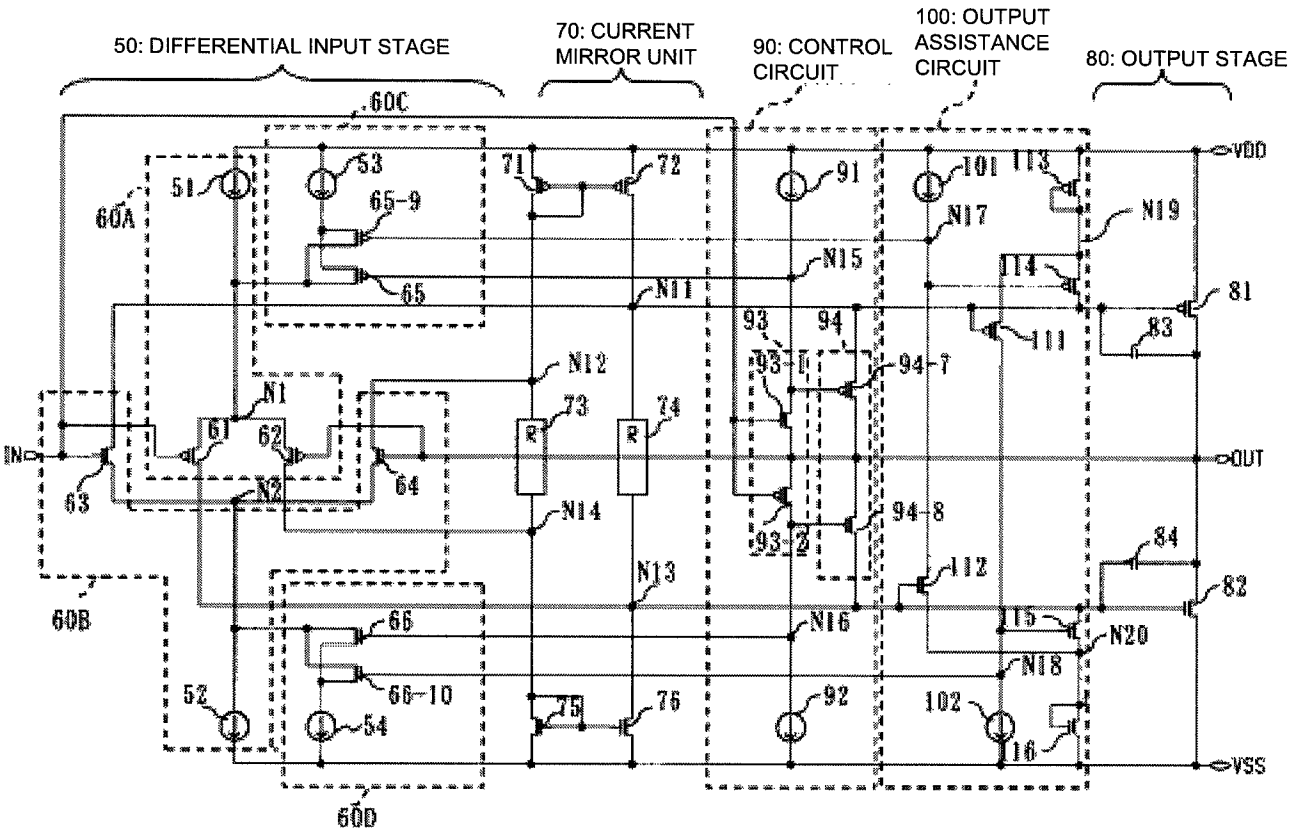
FIG. 16 RELATED ART
FIG. 16 is a circuit diagram showing a configuration of a related technology (Patent Document 1).

According to the present invention, in realizing a high-speed operation, it is unnecessary to increase a current that drives the differential pair as in the related art technology (FIG. 16). Thus, according to the present exemplary embodiment, while a high speed driving is realized, the power consumption may be reduced.

Comparison of the Present Exemplary Embodiment with the Related Technology

The following description is based on comparison of the amplification acceleration circuit 10 of the present exemplary embodiment, shown in FIG. 1, to the control circuit 90 of the related art shown in FIG. 16.

In the amplification acceleration circuit 10 of the present exemplary embodiment, the transistors 103 and 104 operate in response to the potential difference between the input voltage VI and the output voltage VO to directly change the gate voltages of the output stage transistors 101 and 102. Hence, the response speed of the amplification acceleration is high, such that, when the output voltage VO has reached the vicinity of the input voltage VI, the operation of the amplification acceleration ceases quickly. Moreover, the amplification acceleration circuit 10 including the switches SW1 and SW2 may be constructed using four elements at the minimum.

In the control circuit 90 of the foregoing related technology of FIG. 16, the transistors 93-1 and 93-2 operate in accordance with the potential difference between the input voltage VI and the output voltage VO to convert the potential difference temporarily into a voltage change at connection nodes between the drains of the transistors 93-1 and 93-2 and the current sources 91 and 92 (nodes N15 and N16). The transistors 94-7 and 94-8 operate in accordance with the voltage change at the nodes N15 and N16 to change the gate voltages of the output stage transistors 81 and 82. Hence, in the related technology of FIG. 16, the minimum number of the elements needed is larger than that of the amplification acceleration circuit 10 of the present exemplary embodiment, and hence the circuit size is increased.

Moreover, in the foregoing related technology of FIG. 16, the response speed of the voltage change of the nodes N15 and N16 depends on the difference between the currents flowing through the transistors 93-1, and 93-2 and the current flowing through the current sources 91 and 92, respectively.

Thus, if, in the related technology of FIG. 16, the currents flowing through the current sources 91 and 92 are large, the response to change the gate voltages of the output stage transistors 81 and 82 is delayed. On the other hand, if, in the related technology of FIG. 16, the current values of the current sources 91 and 92 are small, cessation of changes in the gate voltages of the output stage transistors 81 and 82 is delayed.

In the control circuit 90 of the related technology of FIG. 16, it is necessary to control the auxiliary current sources 53 and 54 of the differential amplifier stage 50 depending on the voltages on the nodes N15 and N16. Hence, the configuration such as the amplification acceleration circuit 10 of the present exemplary embodiment, shown in FIG. 1, may not be used. The foregoing is the comparison of the present exemplary embodiment of FIG. 1 with the related technology of FIG. 16.

Operation of the Exemplary Embodiment 1

Switch Control

Figure 2:
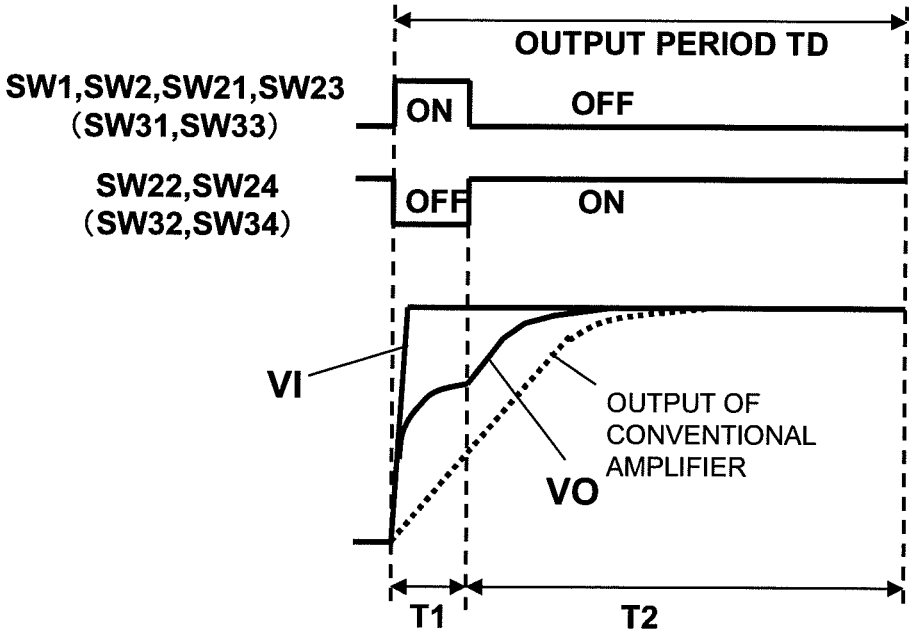
FIG. 2 is a timing diagram for illustrating the operation of the exemplary embodiment 1.

FIG. 2 shows an example of control timing of each switch of the output circuit of FIG. 1, driving a wiring load connected to the output terminal 2, and the output voltage waveform.

In an example shown in FIG. 2, the output voltage VO in accordance with the input voltage VI is output at the output terminal 2. One output period TD, in which an output voltage VO in accordance with the input voltage VI is outputted, includes periods T1 and T2.

It is assumed that the input voltage VI is a step signal with a period corresponding to an output period. The input voltage VI may takes the same voltage during a plurality output periods in succession.

FIG. 2 shows the state of one output period when the input voltage VI is appreciably moved towards a high voltage side (power supply E1 side). Referring to FIG. 2, during the period T1 following the start of the one output period TD, the switches SW1, SW2, SW3 and SW4 are turned on, while the switches SW22, SW24 are turned off. The transistors 103 and 104 of the amplification acceleration circuit 10 are able to operate and the capacitive elements C1 and C2 are connected to the voltage supply terminals NE1 and NE2, respectively.

When the input voltage VI is changed appreciably towards the power supply E1 (high potential power supply) with respect to the output voltage VO and the difference VI-VO which corresponds to the gate-to-source voltage of the transistor 103 of the amplification acceleration circuit 10 is not less than its threshold voltage, the transistor 103 is turned on. The voltage at the gate of the output transistor 101 (node 3) is lowered to the voltage VO of the output terminal 2.

This enlarges the gate-to-source voltage of the output stage transistor 101 to quickly charge the output terminal 2 such as to cause the output voltage VO to approach to the input voltage VI.

If a wiring load capacitance is large, the output voltage VO is quickly changed immediately after the change in the input voltage VI. However, the output voltage becomes dull from halfway.

This is caused by the fact that, as the output voltage VO rises, the voltage at the gate of the output stage transistor 101 (node 3) rises to lower the charging capability of the output terminal 2 by the output stage transistor 101, at the same time as electric charges are propagated from the output terminal 2 into the wiring load.

In FIG. 2, the wiring load is not shown. It is however indicated by an equivalent circuit made up of a plurality of resistance elements connected in series and a plurality of capacitive elements connected between connection nodes of the resistance elements and GND.

During the period T1, the second terminals of the capacitive elements C1 and C2 are connected to the voltages NE1 and NE2. The capacitive elements C1 and C2 are quickly charged/discharged to follow a rapid change in the output voltage VO.

In output circuits described later with reference to FIGS. 9 and 10, potential variations at the second terminals of the capacitive elements C1 and C2 are small. Thus, by setting the voltages NE1 and NE2 in the vicinity of the potential at the second terminals, the capacitive elements C1 and C2 may be charged/discharged against rapid change in the output voltage VO. It is thus possible to cause quick transition to the amplifying operation by the differential amplifier stage 50 after lapse of the period T1.

During the period T2 next following the period T1, the switches SW1, SW2, SW21 and SW23 are turned off, while the switches SW22, SW24 are turned on, and hence the amplification acceleration circuit 10 is deactivated. The second terminals of the capacitive elements C1 and C2 are connected to the nodes 7 and 8 of the differential amplifier stage 50. The output circuit of FIG. 1 then operates as a usual differential amplifier.

The capacitive elements C1 and C2 are charged/discharged in response to a rapid change in the output voltage VO. Hence, a quick transition occurs from period T1 to period T2.

During the time from the end of period T1 until the ultimate voltage value in keeping with the input voltage VI is reached, the second terminals of the capacitive elements C1 and C2 are charged/discharged by the driving current of the differential pair of the differential amplifier stage 50. The output voltage VO is changed at a corresponding driving speed.

Figure 18:
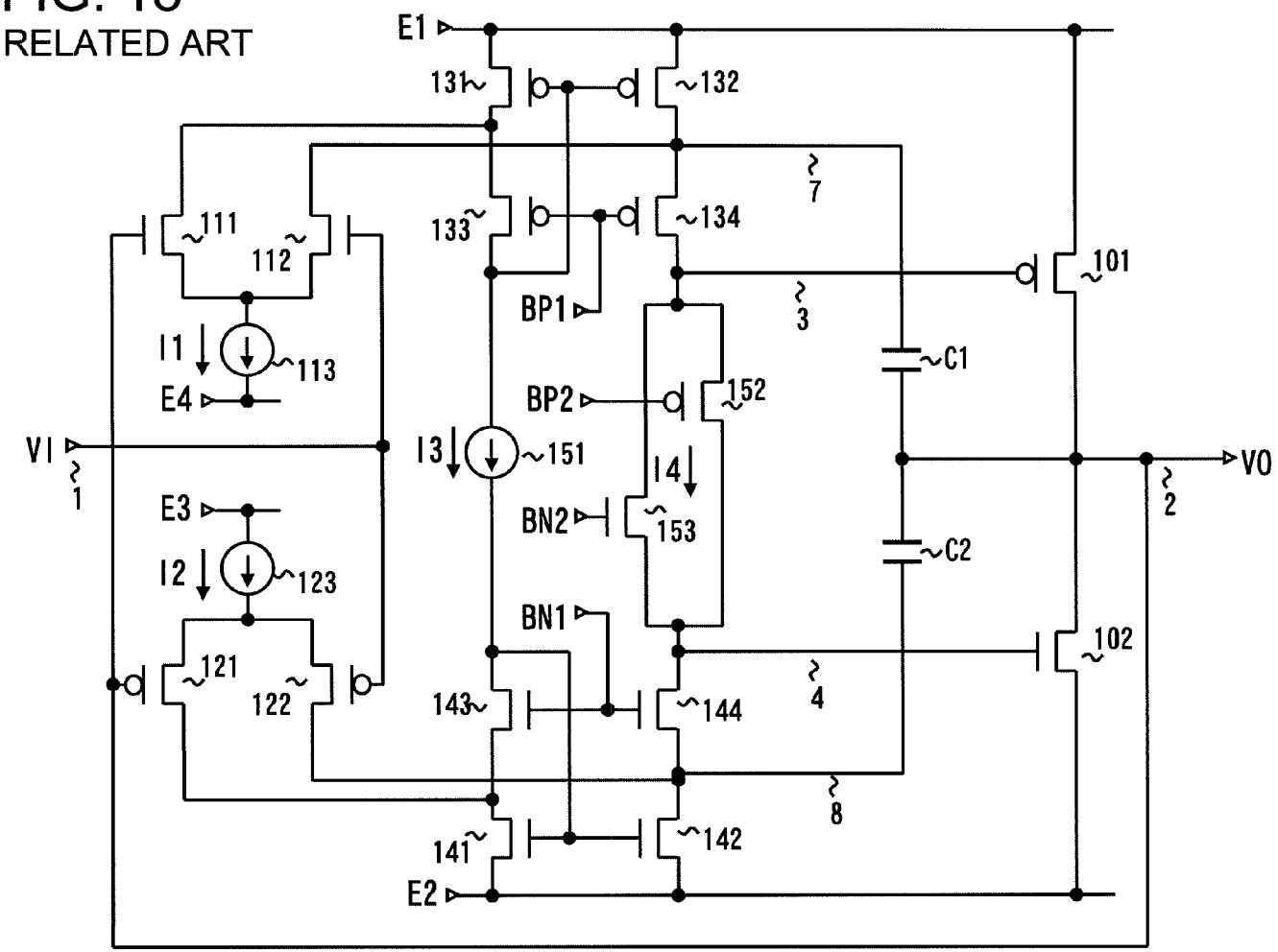
FIG. 18 RELATED ART
FIG. 18 is a circuit diagram showing a configuration of still another related technology (Patent Document 3).

A broken line in FIG. 2 shows an output waveform of a differential amplifier of the related technology, such as is shown in FIG. 18 (Comparative Example). It is shown therein that the output voltage transitions at a constant slew rate responsive to a change in the input signal VI.

The slew rate is determined by the current which drives the differential pair and the capacitance of the phase compensation capacitor, as explained in connection with a differential amplifier of the related technology shown in FIG. 18. In the present exemplary embodiment, the amplification acceleration circuit 10 performs a rapid change in the output voltage, while the voltage supply terminals NE1 and NE2 take charge of rapid charging/discharging of the capacitive elements C1 and C2. It is thus possible to implement driving at a higher speed than with the driving at the slew rate in the differential amplifier of the related technology. Moreover, with the present exemplary embodiment, high speed driving may be implemented without increasing a current of the differential amplifier stage 50. Hence, the current consumption may be lesser than in the differential amplifier of the related technology, thus assuring low power consumption.

Although such case where the input voltage VI is changed appreciably toward the power supply E2 (low power supply) is not shown, control is performed in much the same way as during the periods T1 and T2 of FIG. 2. During the period T1, the transistor 104 of the amplification acceleration circuit 10 is turned on to cause change in the voltage at the gate (node 4) of the output transistor 102 and hence the output voltage VO is caused to approach to the input voltage VI by rapid discharging by the output transistor 102. The capacitive elements C1 and C2 are also charged/discharged to follow the rapid change in the output voltage VO.

During the period T2, the amplification acceleration circuit 10 is deactivated. The output circuit of FIG. 1 transitions to a normal operation of the differential amplifier to drive the output terminal 2 to an output voltage which is in accordance with the input signal VI.

The following supplementary description is to be made for the switches SW1 and SW2.

The switches SW1 and SW2 control the activation/deactivation of the amplification acceleration circuit 10 and prevent malfunctions of the transistors 103 and 104 from occurrence.

In the driving of the wiring load by the differential amplifier, electric charges are propagated into the wiring load by the differential amplifier even though the output voltage approaches to the input voltage VI. Hence, the differential amplifier continues supplying a large current to the output terminal 2 until the driving of a remote end of the wiring load comes to a close.

For this reason, voltage at the gate of the output stage transistor of the differential amplifier is varied appreciably to supply a sufficient amount of current.

Suppose that, if, during the period T2 of FIG. 2, the amplification acceleration circuit 10 is activated, the output voltage VO approaches to the input voltage VI. In such case, no problem occurs, if the operation of the amplification acceleration circuit 10 should cease automatically.

There are however cases where, when the input voltage VI is a high voltage close to the power supply E1, the voltage at the gate of the output stage transistor 101 is varied towards the low voltage side. It is because that a current is to be supplied to the wiring which is load connected to the output terminal 2, even though the output voltage VO approaches to the vicinity of the input voltage VI. At this time, the Nch transistor 103 is turned on to deter a voltage variation towards the low potential side of the gate of the output stage transistor 101. As a result, the driving speed of the wiring load is slowed down.

However, in the present exemplary embodiment, the switches SW1 and SW2 control the amplification acceleration circuit 10 to deactivation during the period T2 of FIG. 2 to prevent the slow down of driving speed of the wiring load.

Exemplary Embodiment 2

Figure 3:
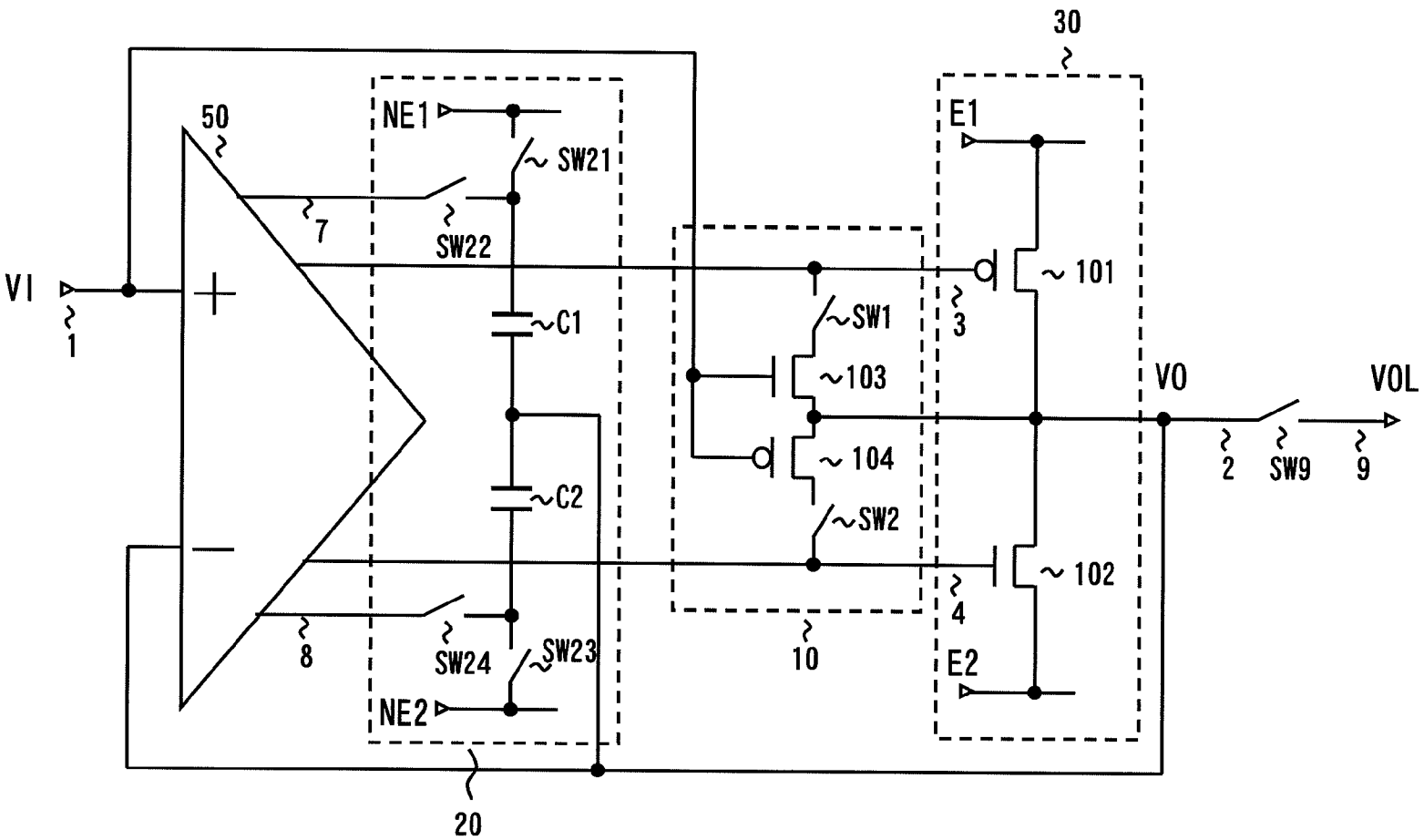
FIG. 3 is a circuit diagram showing a configuration of an exemplary embodiment 2 of the present invention.

An exemplary embodiment 2 of the present invention will now be described. FIG. 3 shows a configuration of the exemplary embodiment 2 of the present invention. Referring to FIG. 3, in the exemplary embodiment 2, as contrasted to the configuration of FIG. 1, a switch (output switch) SW9 is provided between the output terminal 2 and a wiring load. The output switch SW9 temporarily disconnects the output terminal 2 and the wiring load.

As long as the output switch SW9 is off, movement of electric charges from the output terminal 2 to the wiring load is interrupted. Thus, by the operation of the amplification acceleration circuit 10, the output voltage VO is rapidly changed to close to the input voltage VI, without becoming dull. The capacitive elements C1 and C2 are also charged/discharged in keeping with the output voltage.

The capacitive elements C1 and C2 are fully charged/discharged when the ultimate target voltage value of the output voltage VO is almost reached, whereupon the switch SW9 is turned on to drive the wiring load at an elevated speed.

In driving a data line of the display device, there is a case in which the data line and the output circuit is temporarily disconnected at the output period switching time. The output switch SW9 may be used as a switching circuit for such a case.

Figure 4:
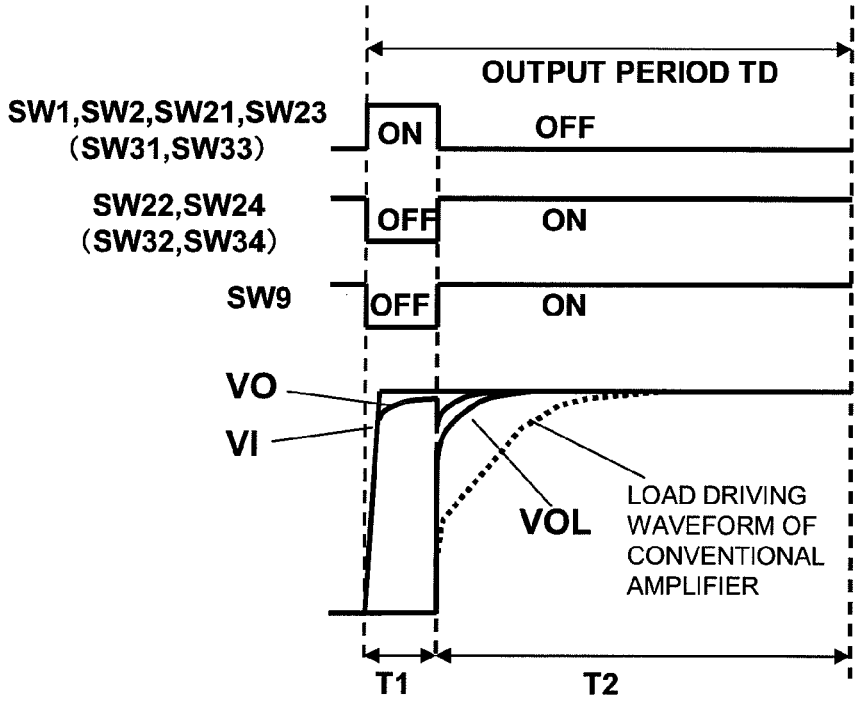
FIG. 4 is a timing diagram for illustrating the operation of the exemplary embodiment 2.

FIG. 4 is a timing diagram for illustrating the control timing of each switch in the output circuit of FIG. 3 that drives the wiring load connected via the output switch SW9 to the output terminal 2. For one output period TD, there are provided periods T1 and T2.

Like FIG. 2, FIG. 4 shows the state of one output period in case the input voltage VI is appreciably changed towards the high voltage (power supply E1) side. Referring to FIG. 4, during the period T1 after the start of one output period TD, the switches SW1, SW2, SW21 and SW23 are on, while the switches SW22, SW24 and SW9 are off. The operation of the transistors 103 and 104 of the amplification acceleration circuit 10 is enabled and hence the second terminals of the capacitive elements C1 and C2 are connected to the voltage supply terminals NE1 and NE2.

When the input voltage VI is changed appreciably towards the power supply E1 side (high power supply side), the transistor 103 of the amplification acceleration circuit 10 is turned on. The voltage at the gate (node 3) of the output transistor 101 is changed to quickly charge the output terminal 2 to cause the output voltage VO to approach to the input voltage VI. At the same time, the capacitive elements C1 and C2 are also quickly charged/discharged by the electric charges supplied from the voltage supply terminals NE1 and NE2 to follow rapid changes in the output voltage VO.

Since the output terminal 2 is disconnected from the wiring load by the output switch SW9, the output voltage VO instantaneously reaches the vicinity of the input voltage VI without becoming dull. The capacitive elements C1 and C2 are fully charged/discharged to close to the ultimate voltage value of the output voltage VO.

After the end of the period T1, the switches SW1, SW2, SW21 and SW23 are turned off and, during the period T2 following the period T1, the switches SW22 and SW24 are turned on, after which the output switch SW9 is turned on. This causes cessation of the operation (deactivation) of the transistors 103 and 104 of the amplification acceleration circuit 10. The second terminals of the capacitive elements C1 and C2 are connected to the nodes 7 and 8, respectively. The output terminal 2 is connected via the output switch SW9 to the wiring load.

The output circuit of the present exemplary embodiment, shown in FIG. 3, then transfers to the usual operation of the differential amplifier during the period T2.

At the instance when the output terminal 2 is connected to the wiring load, the output voltage VO is slightly lowered due to charge propagation to the wiring load. Thereafter, the output voltage VO approaches to ultimate target voltage which is in keeping with the input voltage VI.

During the period T1, a voltage VOL of the connection node 9 of the output switch SW9 and the wiring load is disconnected from the output terminal 2 by the output switch SW9, and the voltage held is to a voltage of the directly previous output period. Directly after the output switch SW9 is turned on during the period T2, the voltage VOL is instantaneously driven to close to the input voltage VI. Thereafter, the voltage VOL approaches to the ultimate voltage value which is in accordance with the input voltage VI.

A broken line in FIG. 4 is an output waveform of a voltage at a connection node between an output switch and a wiring load in case the wiring load is driven by a differential amplifier of the related technology (such as one shown in FIG. 18) via the output switch (waveform for comparison with the waveform of the voltage VOL).

As explained in connection with the differential amplifier of the related technology, shown in FIG. 18, the slew rate is determined by the current driving the differential pair and the phase compensation capacitor. Hence, the output terminal voltage is varied without dependency on the possible presence of connection of the differential amplifier to the wiring load.

For this reason, as the voltage at a connection node between the output switch of the differential amplifier of the related technology and the wiring load during the period T1 (broken line of FIG. 4), the voltage during the directly previous output period is kept. During the period T2, the node voltage is instantaneously changed to a voltage at a constant slew rate for the period T1, after which it approaches to the ultimate target potential which is in accordance with the input voltage V1 at the same slew rate as that for the period T1.

In the present exemplary embodiment, the output terminal 2 is electrically disconnected from the wiring load by the output switch SW9 in the period T1. Hence, the voltage at the output terminal 2 may be changed to a voltage just ahead of the ultimate target voltage value of the output voltage VO without being affected by charge propagation to the wiring load. The capacitive elements C1 and C2 may also be fully charged/discharged to just ahead of the ultimate target voltage value. It is thus possible to implement the driving of the wiring load at a higher speed than with the differential amplifier of the related technology in which the slew rate is kept constant. Moreover, with the present exemplary embodiment, it is possible to implement the driving at a higher speed than in the output circuit of FIG. 1 that relies on control of FIG. 2 described in connection with the exemplary embodiment 1.

In the present exemplary embodiment, it is only sufficient that the capacitors C1 and C2 are charged/discharged, under the action of the differential amplifier stage 50, by a voltage difference between a voltage slightly lowered from a voltage value immediately after turning on of the output switch SW9 during the period T2 and the ultimate target voltage value of the output voltage VO. Thus, according to the present exemplary embodiment, high speed driving may be achieved without increasing the driving current of the differential pair of the differential amplifier stage 50. According to the present exemplary embodiment, it is thus possible to reduce power consumption.

Such a case where the input voltage VI is changed appreciably towards the power supply E2 (low power supply side) is not shown. In such case, control is exercised as in the periods T1 and T2 of FIG. 4.

During the period T1, the transistor 104 of the amplification acceleration circuit 10 is turned on so that the gate of the output stage transistor 102 (node 4) is changed. This rapidly discharges the output voltage VO at the output terminal 2 to close to the input voltage VI. At the same time, the capacitors C1 and C2 are also charged/discharged rapidly. During the period T2, the amplification acceleration circuit 10 is deactivated, such that the output circuit of FIG. 3 transfers to the normal differential amplifier operation.

The output terminal 2 is connected via the output switch SW9 to the wiring load. The voltage value of the output voltage VO slightly rises, at the instance when the output terminal 2 is connected to the wiring load, owing to charge propagation to the wiring load. Thereafter, the voltage value quickly approaches to the ultimate target voltage value which is in accordance with the input voltage VI.

During the period T1, a voltage (VOL) during the directly previous output period is kept at the node 9 of the wiring load. Directly after turning on of the output switch SW9 during the period T1, the voltage (VOL) is instantaneously driven to close to the input voltage VI. Thereafter, the voltage (VOL) approaches to the ultimate target voltage value which is in accordance with the input voltage VI.

Exemplary Embodiment 3

Figure 5:
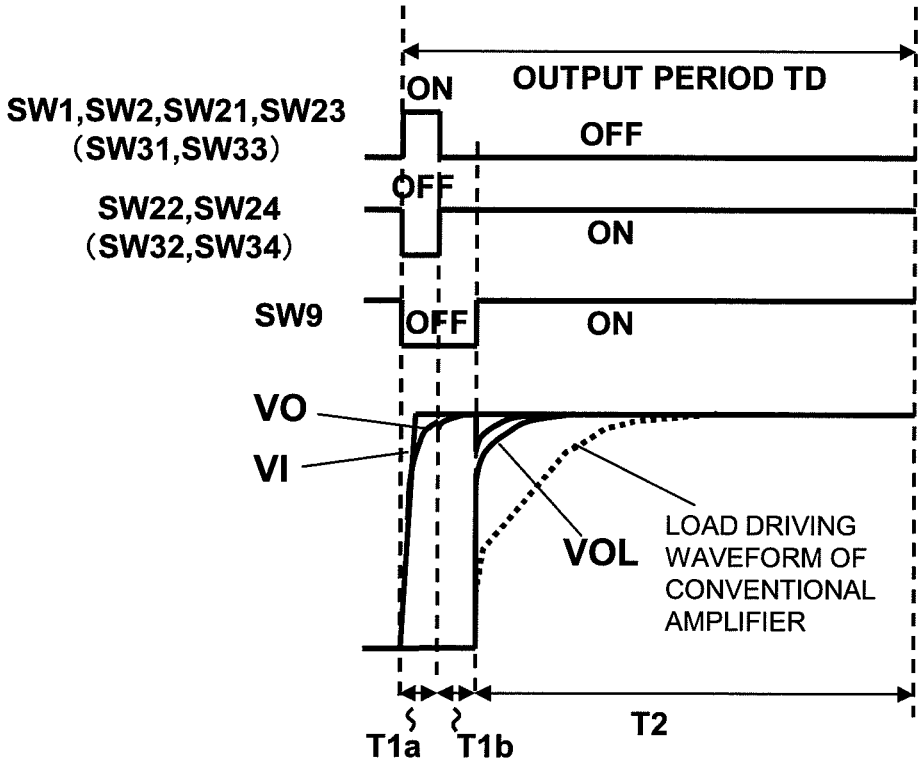
FIG. 5 is a timing diagram for illustrating the operation of a modification of the exemplary embodiment 2.

An exemplary embodiment 3 of the present invention will now be described. FIG. 5 is a waveform timing diagram for explaining the exemplary embodiment 3 of the present invention. The configuration of the present exemplary embodiment is to be the same as that of the exemplary embodiment of FIG. 3 described above.

In the present exemplary embodiment, the timing control of FIG. 4 is modified. FIG. 5 illustrates control timings of various switches of the output circuit of FIG. 3 that drives the wiring load connected to the output terminal 2 via the output switch SW9.

Referring to FIG. 5, the period T1 of FIG. 4 is split into periods T1*a* and T1*b*. During the period T1*a*, the switches SW1, SW2, SW21 and SW23 are turned on, while the switches SW22 and SW24 are turned off. During the periods T1*b* and T2, the switches SW1, SW2, SW21 and SW23 are turned off, while the switches SW22 and SW24 are turned on. The output switch SW9 is turned off during the periods T1*a* and T1*b* and is turned on during the period T2.

It has been explained in connection with FIG. 4 that, when the output switch SW9 is turned off, the output voltage VO is instantaneously changed to close to the input voltage VI, by the operation of the amplification acceleration circuit 10, and that the capacitive elements C1 and C2 are also charged/discharged rapidly.

In the switch control of the present exemplary embodiment, shown in FIG. 5, a change in the output voltage VO and rapid charging/discharging of the capacitive elements C1 and C2 may be completed during the sufficiently short period T1*a*. During the next period T1*b*, the output voltage VO is caused to reach the ultimate target voltage value, which is in accordance with the input voltage VI, by the output circuit of FIG. 3 the operation of which has shifted to the normal differential amplifier operation. This completes the charging/discharging which is in accordance with the ultimate target voltage value of the output voltage VO.

During the period T2, the output terminal 2 is connected to the wiring load. The voltage value of the output voltage VO is slightly lowered, at the instance when the output terminal 2 is connected to the wiring load, due to charge propagation to the wiring load. However, the voltage value quickly approaches to the ultimate target voltage value which is in keeping with the input voltage VI.

During the periods T1*a* and T1*b*, the voltage VOL at the connection node 9 between the output switch SW9 and the wiring load, is electrically disconnected from the output terminal 2 by the output switch SW9. A voltage of the preceding output period is kept as the voltage VOL. Directly after turning on of the output switch SW9 in the period T2, the voltage VOL is driven to close to the input voltage V1, and thereafter approaches to the ultimate target voltage value which is in accordance with the input voltage VI. A broken line in FIG. 5 depicts an output waveform of a voltage at a connection node between the output switch and the wiring load in case the wiring load is driven by a differential amplifier of the related technology (such as one shown in FIG. 18) via the output switch (waveform for comparison with the waveform of the voltage VOL), as in FIG. 4.

With the control shown in FIG. 5, the voltage value at the output terminal 2 is changed, during the periods T1*a* and T1*b*, to the ultimate target voltage value of the output voltage VO to complete the charging/discharging of the capacitive elements C1 and C2 in keeping with the ultimate target voltage value. It is thus sufficient that electric charges corresponding to the slight decrease in the potential difference are delivered to the capacitive elements C1 and C2 to make up for the slight decrease in the potential difference caused immediately after turning on of the output switch SW9 during the period T2. It is thus possible to implement the high speed driving, without increasing the driving current of the differential pair of the differential amplifier stage 50, even in case the capacitive elements C1 and C2 are of larger values, thus reducing the power consumption.

In the exemplary embodiment shown in FIG. 5, the switches SW1 and SW2 are turned on only during the period T1*a*. However, these may also be turned on during the period T1*b* as well. During the period T1*b*, the output circuit of FIG. 3 transfers to the usual differential amplifier operation. It is noted that, as long as the output switch SW9 is turned off, the output stage transistors 101 and 102 drive only the parasitic capacitances on the output terminal 2. There is thus no fear that the voltage at the gates of the output stage transistors 101 and 102 is varied appreciably. Thus, in the present exemplary embodiment, the amplification acceleration circuit 10 remains in a state of automatic operation cessation, such that there is produced no such driving deterring operation explained with reference to FIG. 2.

Exemplary Embodiment 4

Figure 6:
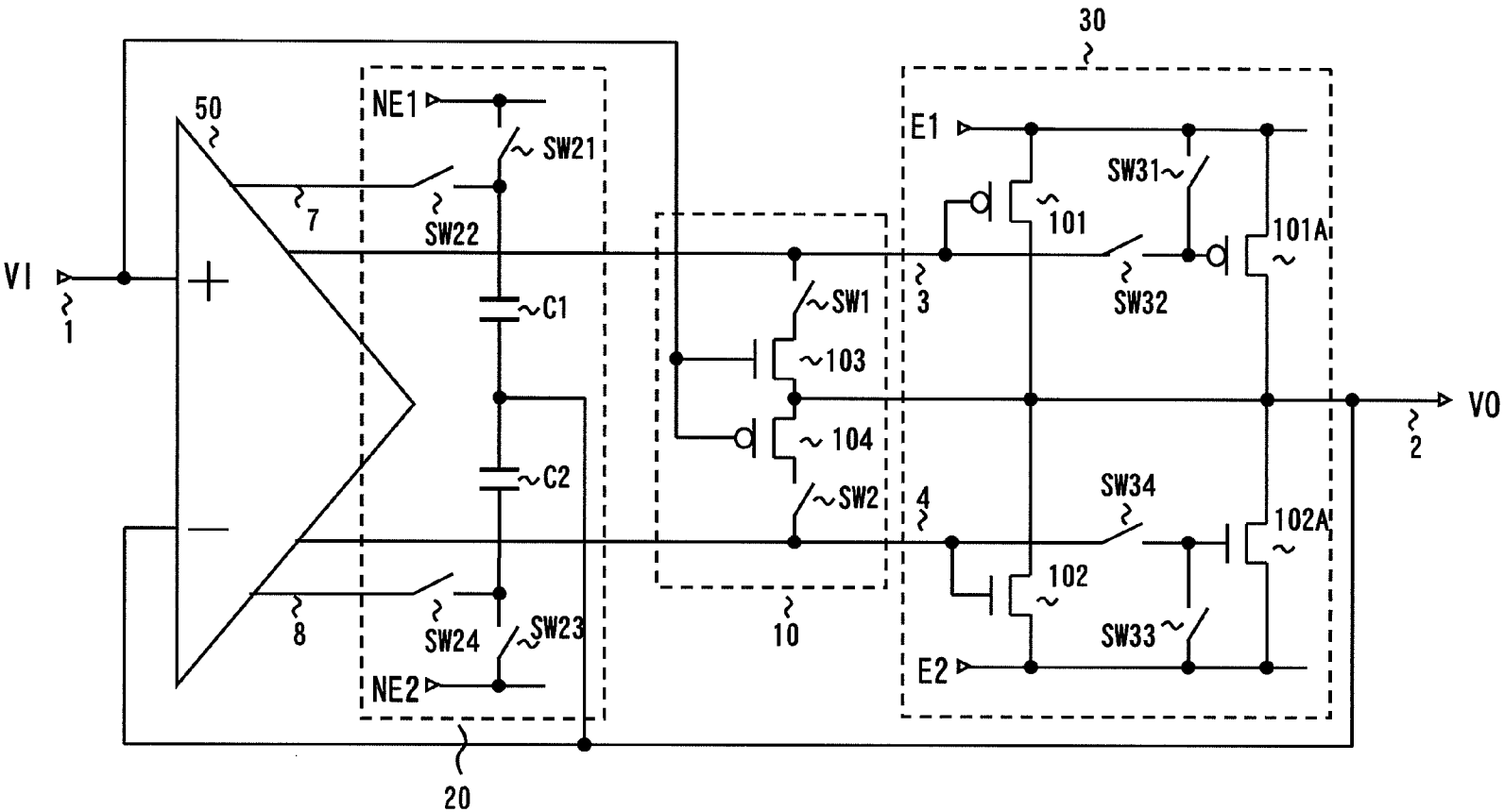
FIG. 6 is a circuit diagram showing a configuration of an exemplary embodiment 3 of the present invention.

An exemplary embodiment 4 of the present invention will now be described with reference to FIG. 6 showing its configuration. The present exemplary embodiment is a modification of the exemplary embodiment of FIG. 1.

If, in the circuit configuration of FIG. 1, the capacitance of the wiring load is larger and hence the size of the output stage transistors 101 and 102 has to be increased, because of the high speed operation, a parasitic capacitance between gates and drains of the output stage transistors 101 and 102 (output terminal 2) is increased.

Figure 17:
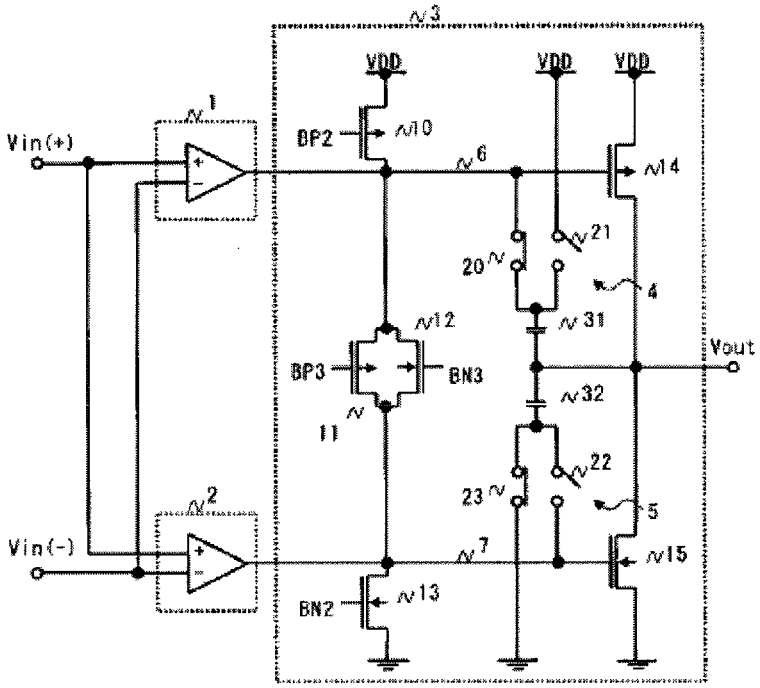
FIG. 17 RELATED ART
FIG. 17 is a circuit diagram showing a configuration of another related technology (Patent Document 2).

If, in such output circuit, the output voltage VO is changed rapidly due to the amplification acceleration circuit 10, it may sometimes occur that the shoot-through current is generated due to capacitive coupling of the parasitic capacitance. The current value of the shoot-through current is sufficiently smaller than the shoot-through current generated by connection of the capacitive elements across the gates and the drains (output terminals) of the output stage transistors explained in connection with the related technology (FIGS. 16 and 17). However, if low power consumption is particularly desirable, there are cases where the current value of the shoot-through current may not be discounted.

Thus, to prevent the shoot-through current, generated by the capacitive coupling, the output stage transistors are split, in the present exemplary embodiment, into output stage transistors 101 and 102 and output stage transistors 101A and 102A. During the period T1 when the output voltage VO is changed rapidly (period T1 of FIG. 2), switches S31 and S33 are turned on, while switches S32 and S34 are turned off, by the amplification acceleration circuit 10, such as to deactivate the output stage transistors 101A and 102A during the above period T1. At this time, the output stage transistors 101A and 102A are deactivated in a state these transistors are connected to the output terminal 2.

During the period T2 (the period T2 of FIG. 2), the switches S31 and S33 are turned off, while switches S32 and S34 are turned on, such as to activate the output stage transistors 101A and 102A.

In case the output voltage VO is changed rapidly, the capacitive coupling of the parasitic capacitances of the output stage transistors 101 and 102 is produced. However, by splitting the output stage transistors 101 and 102, the parasitic capacitances may be decreased to suppress the shoot-through current. The output stage transistors 101A and 102A are activated during the period T2 after the voltage at the output terminal 2 has approached to the input voltage VI to some extent. Hence, changes in the output voltage VO as from this time point is small so that the capacitive coupling of the parasitic capacitance of the output stage transistors 101A and 102A is also small. However, due to the splitting of the output stage transistors, the capability of causing the voltage at the output terminal connected to the wiring load to approach to a voltage in keeping with the input voltage VI in the period T1 is slightly lowered. It is noted that other switches of FIG. 6 exercise control in the same way as in FIG. 2.

Exemplary Embodiment 5

Figure 7:
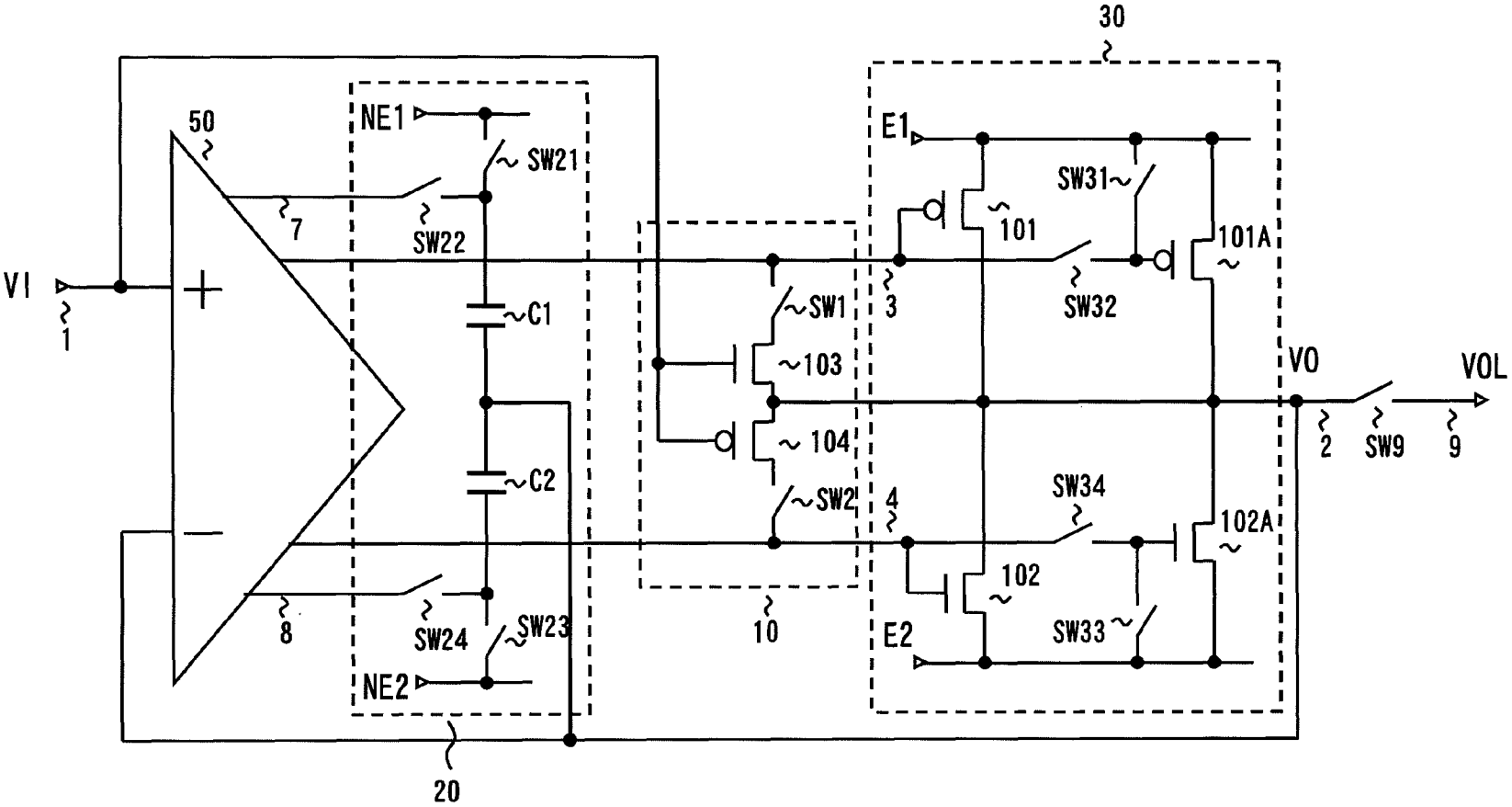
FIG. 7 is a circuit diagram showing a configuration of an exemplary embodiment 4 of the present invention.

An exemplary embodiment 5 of the present invention will now be described with reference to FIG. 7 showing its configuration. The present exemplary embodiment is a modification of the exemplary embodiment of FIG. 3.

If, in the circuit configuration of FIG. 3, the capacitance of the wiring load is larger and hence the size of the output stage transistors 101 and 102 has to be increased because of the high speed operation, the parasitic capacitance between the gates and the drains of the output stage transistors 101 and 102 (output terminal 2) is increased.

If, in such output circuit, the output voltage VO is changed rapidly due to the amplification acceleration circuit 10, it may sometimes occur that the shoot-through current is generated due to capacitive coupling of the parasitic capacitance.

To prevent the shoot-through current from being generated by the capacitive coupling of the parasitic capacitance, the output stage transistors are split, in the present exemplary embodiment, into output stage transistors 101 and 102 of sufficiently small size and output stage transistors 101A and 102A of larger size, as in FIG. 6. During the period of rapid change of the output voltage VO (period T1 of FIG. 4 or period T1*a* of FIG. 5) caused by the amplification acceleration circuit 10, the switches SW31 and SW33 are turned on, while the switches SW32, SW34 are turned off, so that the output stage transistors 101A and 102A will be deactivated during such period. At this time, the output stage transistors 101A and 102A are deactivated in a state where the transistors are connected to the output terminal 2.

During the period when the change in the output voltage VO is small (period T2 of FIG. 4 or periods T1*b* and T2 in FIG. 5), the switches SW31 and SW33 are turned off while the switches SW32 and SW34 are turned on, such as to activate the output stage transistors 101A and 102A.

By so doing, if, in case the output voltage VO is changed rapidly, the capacitive coupling of the parasitic capacitance of the small size output stage transistors 101 and 102 should occur, the shoot-through current is scarcely produced because the parasitic capacitance is only small. Or, in case the output voltage VO is changed rapidly, the output voltage VO may instantaneously reach the vicinity of the input voltage VI, even though the output stage transistors 101 and 102 are small in size, because the output switch SW9 is off. On the other hand, the output stage transistors 101A and 102A are deactivated (off-state) during the period when the output voltage VO is changed rapidly. However, drain terminals of the output stage transistors 101A and 102A, connected to the output terminal 2, are varied to close to the input voltage VI, such as to follow the output voltage VO. Hence, voltage variations at the drain terminals after activation (turning-on) of the output stage transistors 101A and 102A are small. The capacitive coupling of the parasitic capacitance caused by the parasitic capacitances of the output stage transistors 101A and 102A is therefore small. It is thus possible to suppress the shoot-through current otherwise caused by the parasitic capacitances of the output stage transistors 101A and 102A, During the period when the output switch SW9 is off, with the output terminal 2 and the wiring load being electrically disconnected from each other, the output voltage VO may be caused to vary at an elevated speed by the output stage transistors 101 and 102 of sufficiently small size.

On the other hand, during the period when at least the output switch SW9 is turned on (period T2 of FIG. 4 or period T2 in FIG. 5), the switches SW31 to SW34 are controlled such as to activate the output stage transistors 101A and 102A.

It is noted that the switches SW31 to SW34 are controlled so that the output stage transistors 101A and 102A will be activated during the period when rapid changes in the output voltage VO have come to a close (period T1*b* of FIG. 5), even before the output switch SW9 is turned on.

In the present exemplary embodiment, the respective switches of FIG. 7, other than those described above, are controlled in the same way as in FIGS. 4 and 5. In the output circuit shown in FIG. 7, a high-speed operation may be achieved as the shoot-through current is suppressed, even if the wiring load capacitance is large.

Exemplary Embodiment 6

Figure 8:
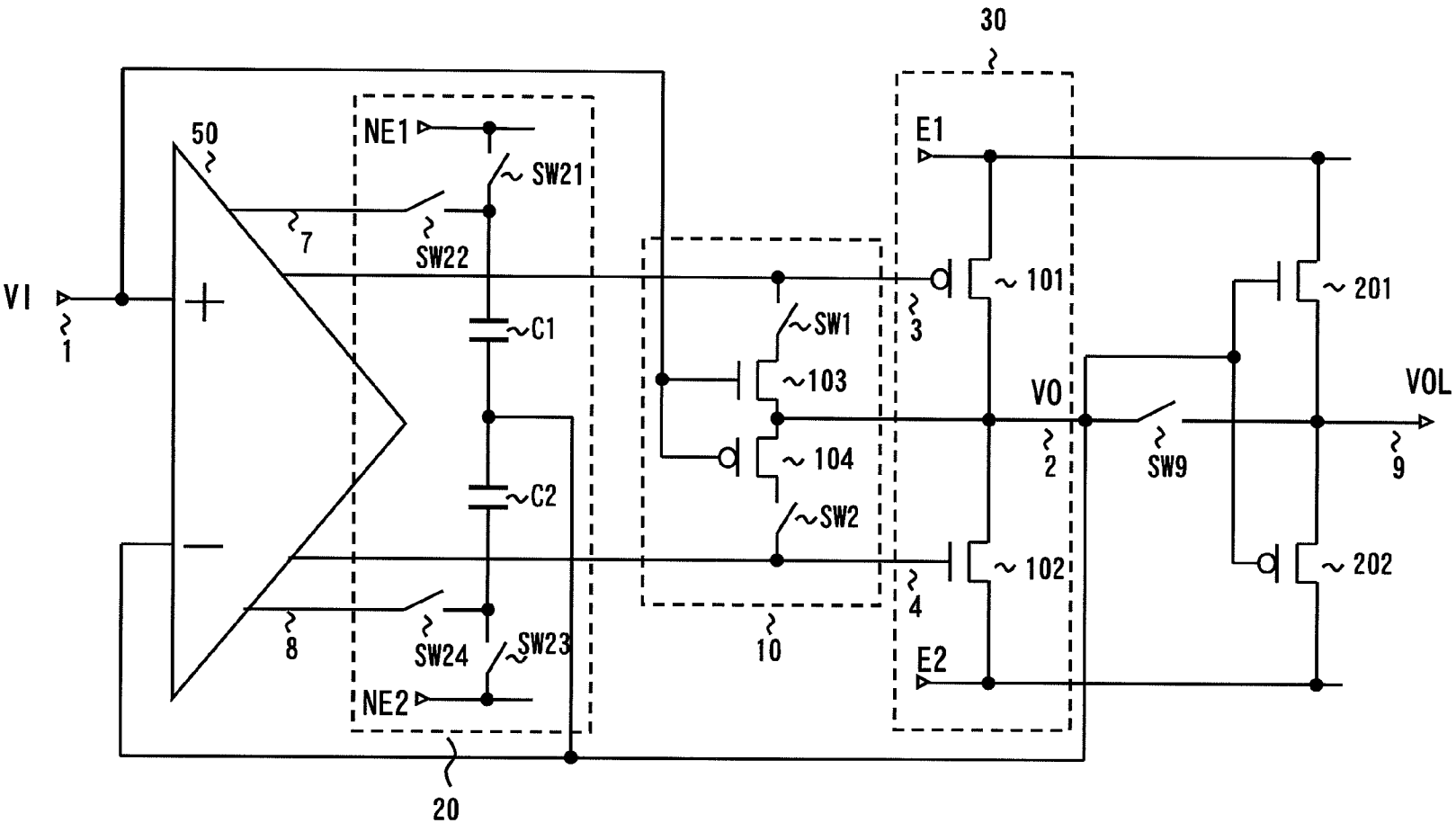
FIG. 8 is a circuit diagram showing a configuration of an exemplary embodiment 5 of the present invention.

An exemplary embodiment 6 of the present invention will now be described with reference to FIG. 8 showing its configuration. The present exemplary embodiment is a modification of the exemplary embodiment of FIG. 3.

If the switch control shown in FIG. 4 is to be exercised on the output circuit of FIG. 3, a start timing of driving the wiring load is from a period T2, when the output switch SW9 is turned on in changing over the output period.

If, in the switch control of FIG. 4, the wiring load may be driven even in the period T1, driving at a higher speed is possible in order to cope with data line driving of a display device with a high frame frequency and a short output period.

Thus, in the present exemplary embodiment, there are additionally provided an N-channel transistor 201 and a Pch transistor 202. These transistors have sources connected in common to a connection node 9 of the output switch SW9, while having drains connected to power supplies E1 and E2, respectively and having gates connected in common to the output terminal 2.

If, with the output circuit of the present exemplary embodiment, shown in FIG. 8, switch control shown in FIG. 4 is to be exercised, the output terminal 2 is rapidly driven to close to the input voltage VI during the period T1.

Thus, during the period T1, the transistors 201 and 202 with gates supplied with the output voltage VO of the output terminal 2 to perform a source follower operation to make it possible to drive the wiring load, to a voltage less than the input voltage VI by approximately the threshold value (absolute value) of the transistor 201 or 202.

During the period T2, the output switch SW9 is turned on to drive the wiring load by the output stage transistors 101 and 102 at an elevated speed up to the ultimate target voltage value which is in accordance with the input voltage VI.

Since the wiring load is driven by the transistors 201 and 202 even during the period T1, the driving at a higher speed than with the output circuit of FIG. 3 may be achieved.

Moreover, since the transistors 201 and 202 of the present exemplary embodiment perform the source follower operation, the shoot-through current ascribable to capacitive coupling of the parasitic capacitance is not produced even though the voltage at the node 9 is rapidly changed. In the period T2, the source follower operation ceases automatically because the gates (output terminal 2) and sources of the transistors 201 and 202 have the same electric potential.

In case the switch control shown in FIG. 5 is to be performed on the output circuit shown in FIG. 8, the driving operation may be performed at a speed higher than with the output circuit of FIG. 3 because the wiring load may be driven to a voltage less than the input voltage VI by a value corresponding to the threshold value (absolute value) of the transistor 201 or 202.

It is noted that, in the case shown in FIG. 8, the transistors 201 and 202 are arranged and constructed so as not to affect the input capacitance of the output circuit.

In the configuration of FIG. 8, the common gates of the transistors 201 and 202 may be connected in common and to the input terminal 1. In this case, however, the input capacitance of the output circuit is increased by a value corresponding to the parasitic capacitance of the common gates of the transistors 201 and 202. In particular, if the sizes of the transistors 201 and 202 are increased to increase the driving capability of the transistors, the input capacitance of the output circuit is also increased. When the input capacitance of the output circuit is increased, the step signal of the input voltage VI of the output circuit becomes dull in case the impedance of a pre-stage circuit, not shown, supplying the input voltage VI to the output circuit, such as a decoder of a display data driver as later explained, is higher. In this case, the output voltage VO of the output circuit is also dull, with the result that high speed driving of the wiring load may not be achieved.

In the case of a circuit configuration, shown in FIG. 8, the input capacitance of the output circuit is not increased by the transistors 201 and 202. On the other hand, the voltage at the common gates of the transistors 201 and 202 which are connected in common to the output terminal 2, may be changed to follow the change in the input voltage VI, based on the high driving capabilities of the output stage transistors 101 and 102, on account of the operation of the amplification acceleration circuit 10. Hence, the wiring load may be driven at an elevated speed, even though an impedance of a pre-stage circuit, not shown, in the output circuit is high. Several concrete Examples will now be described.

EXAMPLE

Example 1

FIG. 9 shows a configuration of Example 1 of the present invention and, specifically, a concrete circuit configuration of the exemplary embodiment of FIG. 1. The configuration shown is an application of the differential amplifier stage of FIG. 18 to the differential amplifier stage 50 of FIG. 1. The differential amplifier stage 50 includes:

a first differential stage including first Nch differential pair transistors (112, 111) and a first current source 113 supplying a current to the first Nch differential pair transistors (112, 111);

a second differential stage including second Pch differential pair transistors (122, 121) and a second current source 123 supplying a current to the second Pch differential pair transistors (122, 121);

first Pch pair transistors (132, 131) having first terminals (source terminals) connected in common to a first power supply (E1), having second terminals (drain terminals) connected via first and second nodes (N1, N2) to output pair of the first differential pair transistors (112,111), and having control terminals (gate terminals) coupled together;

second Pch pair transistors (142, 141) having first terminals (source terminals) connected in common to the second power supply (E2), having second terminals (drain terminals) connected via third and fourth nodes (N3, N4) to output pair of the second differential pair transistors (122, 121), and having control terminals (gate terminals) coupled together;

a Pch transistor 134 having a first terminal (source terminal) connected to the first node (N1), having a second terminal (drain terminal) connected to the first output 3 of the differential amplifier stage 50 and having a control terminal supplied with a first bias voltage (BP1);

an Nch transistor 144 having a first terminal (source terminal) connected to the third node (N3), having a second terminal (drain terminal) connected to the second output 4 of the differential amplifier stage 50 and having a control terminal supplied with a second bias voltage (BP2);

a first connection circuit 60L connected between the second and fourth nodes (N2, N4) of the differential amplifier stage 50, and a second connection circuit 60R connected between the first and second outputs (3, 4) of the differential amplifier stage 50. The first node (N1) is the node (7) of the differential amplifier stage 50, to which the second terminal of the first capacitance C1 is connected via a switch SW22, and the third node N3 is the node 8 of the differential amplifier stage 50 to which the second terminal of the second capacitance C2 is connected via a switch SW24. The connection node of the Pch transistor 134 and the second connection circuit 60R is the first output 3 of the differential amplifier stage 50, and the connection node of the Nch transistor 144 and the second connection circuit 60R is the second output 4 of the differential amplifier stage 50.

The first connection circuit (60L) includes:

a Pch transistor 133 having a first terminal (source terminal) connected to the second node N2, having a second terminal (drain terminal) connected to the control terminals (gate terminals) of the first pair transistors (132, 131), and having a control terminal (gate terminal) connected to the control terminal of the Pch transistor (134);

an Nch transistor 143 having a first terminal (source terminal) connected to the fourth node N4, having a second terminal (drain terminal) connected to the control terminals (gate terminals) of the second pair transistors (142, 141) and having a control terminal (gate terminal) connected to the control terminal of the Pch transistor 144; and a current source 151.

The second connection circuit 60R includes:

a Pch transistor 152 having a first terminal (source terminal) connected to the first output 3 of the differential amplifier stage, having a second terminal (drain terminal) connected to the second output 4 of the differential amplifier stage, and having a control terminal supplied with a third bias voltage BP3;

an Nch transistor 153 having a second terminal (drain terminal) connected to the first output 3 of the differential amplifier stage 50 and a first terminal (source terminal) connected to the second output 4 of the differential amplifier stage 50, and having a control terminal supplied with a fourth bias voltage BP4.

In FIG. 9, except for the amplification acceleration circuit 10 and the capacitance connection control circuit 20, the same reference numerals are used to designate elements which are the same as those shown in FIG. 18. The operation of the differential amplifier stage 50 is the same as that explained in connection with the differential amplifier stage shown in FIG. 18. The following explanation is merely supplementary. The node 7 of the differential amplifier stage 50, to which the second terminal of the capacitance C1 may be selectively connected, is one of connection nodes (N1, N2) of the output pair of the Nch differential pair transistors (112, 111) and pair transistors (132, 131), that is, a common drain (N1) of the transistors (112 and 132). The node 7 is also connected to the source of the transistor (134) with a gate supplied with the bias voltage BP1.

Referring to FIG. 9, the Pch transistors 131 to 134 form a low voltage cascode current mirror circuit, while the Nch transistors 141 to 144 also form a low voltage cascode current mirror circuit.

Like the node 7 of the related technology of FIG. 18, the node 7 of FIG. 9 has an operating point kept at all times in the vicinity of a voltage slightly lower than the power supply E1. The node 8 of the differential amplifier stage 50, to which the second terminal of the capacitance C2 may be selectively connected, is one of connection nodes (N3, N4) of the output pair of the Pch differential pair (122, 121) and pair transistors (142, 141), that is, a common drain (N3) of the transistors (122 and 142). The node 8 is also connected to the source of the transistor 144 whose gate receives the bias voltage BN1.

Like the node 8 of FIG. 18, the node 8 of FIG. 9 has an operating point kept at all times in the vicinity of a voltage slightly higher than the power supply E2. Since the voltage change at the nodes 7 and 8 are only small, the voltages at the voltage supply terminals NE1 and NE2 may be set as the constant voltages in the vicinity of the voltages at the operating points of the nodes 7 and 8. The voltage supply terminals NE1 and NE2 may be the power supplies E1 and E2, respectively.

When the destinations of the connection of the second terminals of the capacitive elements C1 and C2 are changed over from the voltage supply terminals NE1 and NE2 to the nodes 7 and 8, voltage variations at the second terminals of the capacitive elements C1 and C2 are scarcely produced. Hence, quick driving of the output terminal 2 may be achieved even at the time of connection switching of the second terminals of the capacitive elements C1 and C2.

It is noted that the node 3 of the differential amplifier stage 50, to which is connected the gate of the output stage transistor 101, is to be the connection node at which the drain of the transistor 134 and the floating current source (152, 153) are connected, and is separated from the node 7 by the transistor 134. The node 4 of the differential amplifier stage 50, to which the gate of the output stage transistor 102 is connected, is a connection node at which the drain of the transistor 144 and the floating current source (152, 153) are connected, and is separated from the node 8 by the transistor 144.

Thus, even if the voltages at the nodes 7 and 8 are varied appreciably in accordance with change in the input voltage VI, or the output voltage VO is changed appreciably, the capacitive coupling of the capacitive elements C1 and C2 is not produced.

The operation of a Comparative Example will now be described.

By way of the Comparative Example of the present Example 1, such a case where only the amplification acceleration circuit 10 of FIG. 1 is applied to the configuration of the related technology of FIG. 18 will now be described. The corresponding drawing is dispended with.

It is assumed that the capacitive elements C1 and C2 are fixedly connected between the output terminal 2 and the nodes 7 and 8. For example, if the input voltage VI is appreciably changed towards the side the power supply E1 (high potential power supply) with respect to the output voltage VO, the amplification acceleration circuit 10 operates. The voltage at the gate of the output stage transistor 101 (node 3) is changed towards the power supply E2. The output voltage VO at the output terminal 2 is rapidly changed towards the side the power supply E1 (high potential).

At this time, the nodes 7 and 8, to which the second terminals of the capacitive elements C1 and C2 are connected, are slightly changed towards the power supply E1 due to capacitive coupling of the capacitive elements C1 and C2.

The drain current of the transistor 134 is thus increased to pull up the potential at the node 3 to deter the operation of the amplification acceleration circuit 10. On the other hand, the drain current of the transistor 144 is decreased to pull up the potential at the node 4. This enhances the gate-to-source voltage of the output stage transistor 102 to produce the shoot-through current in the output stage transistors 101 and 102.

Thus, if simply the amplification acceleration circuit 10 is applied to the circuit configuration of the related technology of FIG. 18, the operation or the advantage of the present invention may not be derived.

By way of a Comparative Example (not shown) of the present invention, the following describes a case where the amplification acceleration circuit 10 is applied to the configuration of the related technology of FIG. 17 and the switches 20 to 23 of FIG. 17 are made to operate similarly to the switches SW22, SW21, SW24 and SW23, respectively.

In the foregoing related technology of FIG. 17, the destination of connection of the second terminal of the capacitance 31 is switched between the power supply VDD and the gate of the output stage transistor 14. The destination of connection of the second terminal of the capacitance 32 is switched between the GND and the gate of the output stage transistor 15.

The voltage supply terminals NE1 and NE2 in the present Example correspond respectively to the power supply VDD and the ground (GND) of FIG. 17.

In this Comparative Example, if the input voltage VI is changed appreciably towards the power supply VDD with respect to the output voltage VO, the amplification acceleration circuit 10 is set into operation to change the destination of connection of the gate of the output stage transistor 14. The output terminal voltage thus is increased rapidly.

At this time, the second terminals of the capacitances 31 and 32 are connected respectively to the power supply VDD and GND to charge/discharge the capacitances 31 and 32 in accordance with a change in the output terminal voltage. When the output terminal voltage approaches to the input voltage VI, the operation of the amplification acceleration circuit 10 ceases automatically. The gate voltages of the output stage transistors 14 and 15 are controlled by the operation of the differential amplifier stage.

When driving the wiring load, the voltage at the output terminal approaches to the voltage at the input terminal to supply a sufficient current to the wiring load. Hence, the gate of the output stage transistor 14 is varied to the GND side so that the output terminal continues to be charged. At this time, the gate voltage of the output stage transistor 14 is varied, depending on resistance and capacitance of the wiring load or a state of the wiring load which is driven by the output stage, and hence it is not constant.

When the second terminals of the capacitances 31 and 32 are connected to the gates of the output stage transistors 14 and 15 (after charging/discharging of the capacitances 31 and 32 in accordance with an increase in the output terminal voltage, based on the operation of the amplification acceleration circuit 10), the gate voltage of the output stage transistor 14 is pulled up towards the power supply VDD, under the capacitive coupling of the capacitance C31, such as to deter the charging operation of the output stage transistor 14. As a result, the driving speed of the wiring load is decreased.

Suppose that the amplification acceleration circuit 10 of the present invention is applied to a differential amplifier, such as that shown in FIG. 17, in which the capacitance is connected to the gate and the drain of the output stage transistor (output terminal) and that switching control similar to that of the capacitance connection control circuit 20 is exercised. In this case, the operation of the differential amplifier following the connection switching may be deterred after connection switching. It is because the voltage at the second terminal of the capacitance tends to be varied appreciably before and after the connection switching. Hence, the operation as well as the advantage of the present invention may not be demonstrated.

The following describes an output circuit, formed by applying the differential amplifier stage of FIG. 18 to the differential amplifier stage 50 of FIG. 3. This output circuit is of such a configuration in which an output switch SW9 is connected between the output terminal 2 of FIG. 9 and a wiring load, although the configuration is not shown. The operation of the output circuit is the same as described with reference to FIGS. 3 to 5.

In particular, in the output circuit of FIG. 3 under switching control of FIG. 5, the voltage at the output terminal 2 is changed, by the amplification acceleration circuit 10, to the ultimate target voltage value of the output voltage VO. By the amplification acceleration circuit 10, charging/discharging of the capacitive elements C1 and C2 may be completed to substantially the ultimate target voltage value of the output voltage VO.

In connection with the output circuit in which the differential amplifier stage of FIG. 18 is applied to the differential amplifier stage 50 of FIG. 3, the following gives a supplemental description of the operation when the output switch SW9 is turned on from its off-state.

Reference is made to the period T2 of FIG. 5. At the beginning of the period T2, the output switch SW9 is turned on from its off-state. The voltage value of the output voltage VO is slightly lowered because electric charges are propagated via the output switch SW9 to the wiring load.

At this time, the second terminals of the capacitive elements C1 and C2 are connected to the nodes 7 and 8, respectively. Due to the voltage change in the output voltage VO, the capacitive elements C1 and C2 undergo slight capacitive coupling, so that the voltages at the nodes 7 and 8 are slightly shifted towards the side the power supply E2.

The drain current of the transistor 134 is then slightly decreased, while the drain current of the transistor 144 is slightly increased. Hence, the gates of the output stage transistor 101 and 102 (nodes 3 and 4) tend to be changed to the side the power supply E2. The output voltage VO, temporarily decreased immediately after turning on of the output switch SW9 during the period T2, is caused to be restored to its pervious voltage. Hence, the amount of electric charges supplemented by the current from the current sources 13 and 14 of the differential amplifier stage 50 is only small. The driving speed is affected only to a lesser extent, even if the driving current of the differential pair of the differential amplifier stage is small.

The closer to a voltage corresponding to the ultimate target voltage value of the output voltage VO, the capacitive elements C1 and C2 are charged/discharged, the higher becomes the speed of driving the output terminal 2 to the ultimate target voltage value, and hence it is made possible to suppress the driving current of the differential pair of the differential amplifier stage 50.

It is noted that the current sources 113 and 123 of the differential amplifier stage 50 may respectively be constituted by an Nch transistor and a Pch transistor. The sources of these transistors are respectively connected to the power supplies E4 and E3. A preset bias voltage is applied to each of the gate terminals of these transistors. The power supplies E4 and E3 may be the same as the power supplies E1 and E2, respectively.

It is noted that the configuration of the differential amplifier stage of the related technology of FIG. 18 may be applied not only to the configuration of FIGS. 1 and 3 but also to the differential amplifier stage 50 of FIGS. 6 to 8.

Example 2

Figure 10:
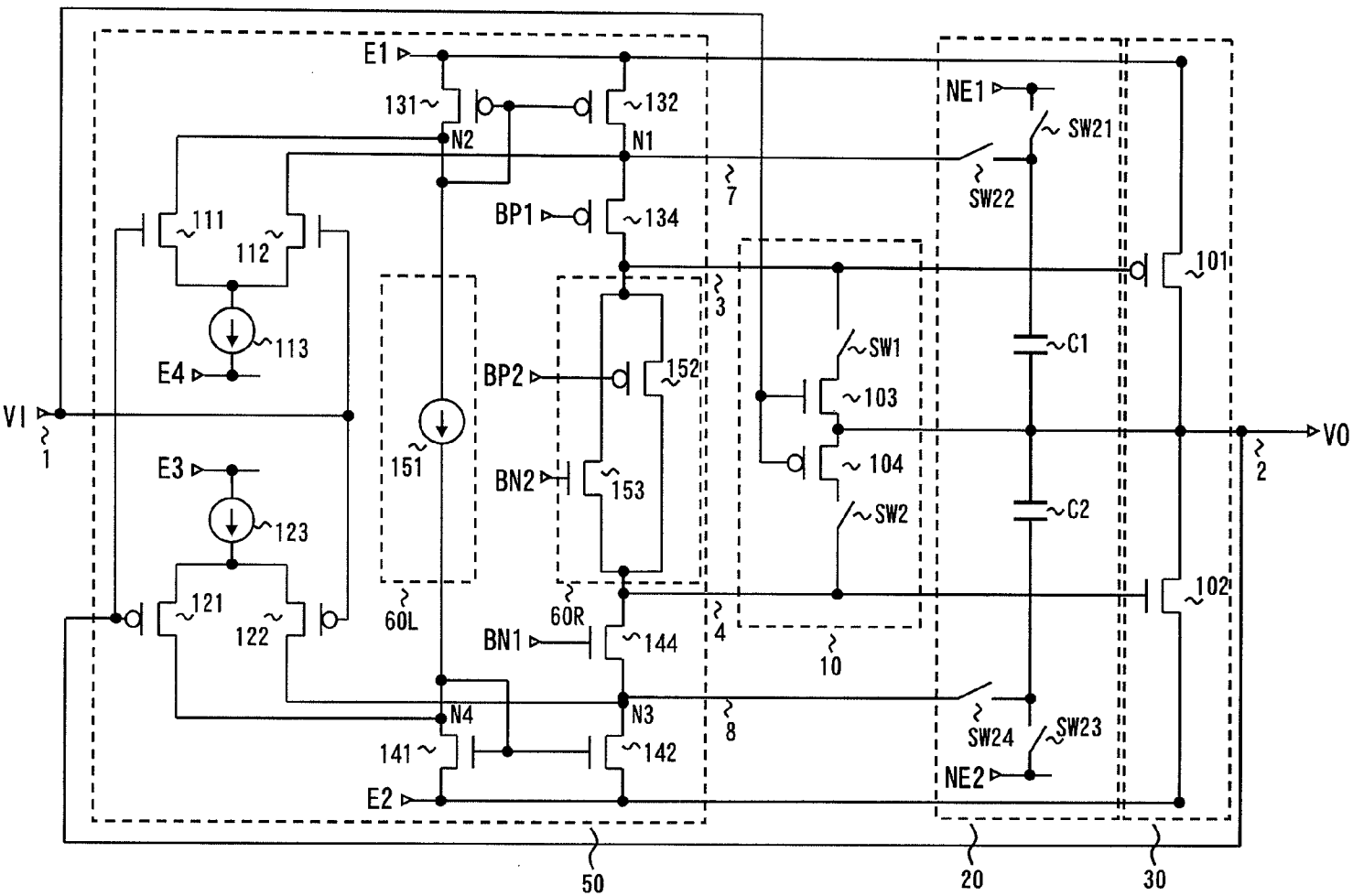
FIG. 10 is a circuit diagram showing a configuration of Example 2 of the present invention

FIG. 10 shows the configuration of Example 2 of the present invention. Referring to FIG. 10, a differential amplifier stage 50 is similar to the differential amplifier stage 50 of FIG. 9, except that the transistors 133 and 143 are deleted from the differential amplifier stage 50 of FIG. 9, the gate terminal of the transistor 131 and one end of the current source 151 are connected to a connection node (N2) of the drain terminal of the transistor 131 and the differential transistor 111, and that the gate terminal of the transistor 141 and the other end of the current source 151 are connected to a connection node (N4) of the drain terminal of the transistor 141 and the differential transistor 121. Since the transistors 133 and 143 are eliminated; the area of the output circuit may be reduced.

The differential amplifier stage 50 shown in FIG. 10 may be replaced by the differential amplifier stage of the output circuit of any of the exemplary embodiments of FIGS. 1, 3 and 6 to 8.

Example 3

Figure 19:
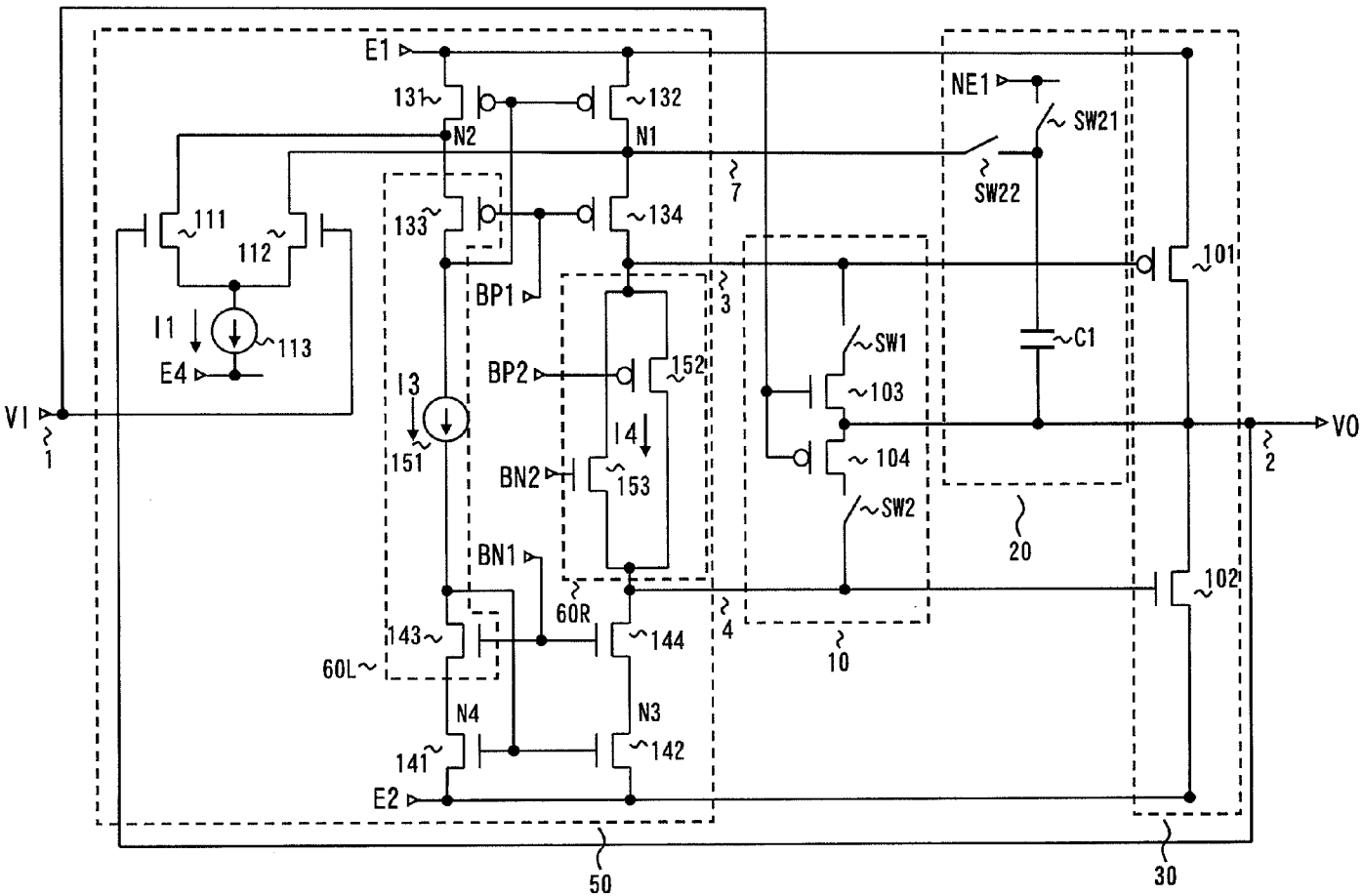
FIG. 19 is a circuit diagram showing a configuration of Example 3 of the present invention

An Example 3 of the present invention will now be described. FIG. 19 shows Example 3 of the present invention. In the differential amplifier stage 50 of the present Example, the Pch differential pair transistors 122 and 121 as well as the current source 123 of the differential amplifier stage 50 of FIG. 9 are deleted. In addition, in the capacitance connection control circuit 20 of FIG. 19, the capacitive element C2, voltage supply terminal NE2 and the switches SW23 and SW24 are deleted from the capacitance connection control circuit of FIG. 9. The differential amplifier stage 50 of the present Example, in which the differential pair transistors of the differential amplifier stage 50 are formed by transistors of the single conductivity type, may operate as differential amplifier.

Referring to FIG. 19, the operation of the differential amplifier stage 50 of the present Example will be described. The current in the current source 113 in the output stable state is designated as I1, the current in the floating current source 151 is designated as 13 and the sum current of the floating current source (152, 153) is designated as 14.

For example, if the input voltage VI at the input terminal 1 is appreciably changed towards the side the power supply E1 (high potential side), the transistors 111 and 112 of the Nch differential pair are turned off and on, respectively. The current I1 of the current source 113 flows through the on-state transistor 112.

Only the current I3 of the current source 151 flows through the transistor 131, and a mirror circuit of the current I3 flows through the transistor 132. At this time, the current flowing through the transistor 132 is smaller than during the output stable state, while the current flowing through the transistor 112 is larger than during the output stable state.

Thus, the voltage at a connection node N1 (node 7) of the transistors 132 and 134 is slightly lowered and becomes lower than the gate-to-source voltage (absolute value) of the transistor 134. The drain current of the transistor 134 is thus decreased.

On the other hand, the current I3 from the current source 151 of the connection circuit 60L flows through the transistor 141, and its mirror current flows through the transistor 142. The value of the current flowing at this time through the transistor 142 is about equal to that under the output stable state.

The voltages at the nodes 3 and 4 flowing through the gates of the output stage transistors 101 and 102 are changed depending on the values of the currents flowing through the transistors 134 and 144.

When the current flowing through the transistor 134 is decreased, the voltages at the nodes 3 and 4 are changed towards the side the power supply E2 (low potential side). The current value of the charging current from the power supply E1 towards the output terminal 2 by the output stage transistor 101 is increased, while the current value of the discharging current by the output stage transistor 102 from the output terminal 2 to the power supply E2 is decreased. This raises the output voltage VO at the output terminal 2. When the output voltage VO is at the input voltage VI, the output stable state is reached.

In the capacitance connection control circuit 20 of FIG. 19, when the switches SW21 and SW22 are off and on, respectively, and the capacitive element C1 is connected between the node 7 and the output terminal 2, and one of the Nch differential pair transistors (112, 111) is on, with the other being off, the output voltage VO at the output terminal 2 is changed at a constant slew rate. At this time, the slew rate of the output voltage VO is given by the flowing expression (4):

$$dVO/dt \approx I1/C1 \quad (4)$$

The expression (4) is derived by setting I2 and C2 to zero in the relationship (3) explained in connection with the related technology (FIG. 18).

The following describes the operation range of the differential amplifier stage 50 of the Example 3 of FIG. 19 and that of the differential amplifier stage 50 of Example 1 of FIG. 9.

In the Example 1 of FIG. 9, the current sources 113, 123 are respectively constituted by an Nch transistor and a Pch transistor. The source terminals of the transistors are connected to the power supplies E4 and E3, and preset bias voltages are applied to the transistor gates.

The differential amplifier stage 50 of Example 3 of FIG. 19 is provided only with the Nch differential pair transistors (112, 111). Hence, the differential amplifier stage may not be in operation in a voltage range of a threshold voltage of the Nch differential pair transistors 111 and 112 from the power supply E1.

On the other hand, the differential amplifier stage 50 of Example 1 of FIG. 9 is provided with the Nch differential pair transistors (112, 111) and the Pch differential pair transistors (122, 121). Thus, even though the operation of the Nch differential pair transistors (112, 111) has ceased in the vicinity of the power supply E4, the operation as the differential amplifier is carried out by the Pch differential pair transistors (122, 121). Moreover, even though the operation of the Pch differential pair transistors (122, 121) has ceased in the vicinity of the power supply E3, the operation as the differential amplifier is carried out by the Nch differential pair transistors (112, 111).

In case the power supply voltages are the same, for example, E3=E1 and E4=E2, the operation range of the differential amplifier stage 50 of FIG. 19 is narrower than that of the differential amplifier stage 50 of FIG. 9.

However, in case the power supply E4 of the differential amplifier stage 50 of Example 3 of FIG. 19 may be made lower than the power supply E2, the differential amplifier stage of Example 3 of FIG. 19 may have the same output voltage range (same voltage range from power supply E1 to power supply E2) as that of the output circuit of FIG. 9.

In Example 3 of FIG. 19, the differential amplifier stage 50 as well as capacitance connection control circuit 20 may be replaced by the differential amplifier stage 50 as well as capacitance connection control circuit 20 of each of the exemplary embodiments of FIGS. 1, 2 and 6 to 8. By the operation of the amplification acceleration circuit 10 and the capacitance connection control circuit 20, explained in the exemplary embodiments, the wiring load may be driven at an elevated speed.

The same may be said of a configuration in which only the Pch differential pair transistors (122, 121) and the current source 123 are provided in place of the Nch differential pair transistors (112, 111) and the current source 113 of Example 3 shown in FIG. 19.

Example 4

Figure 20:
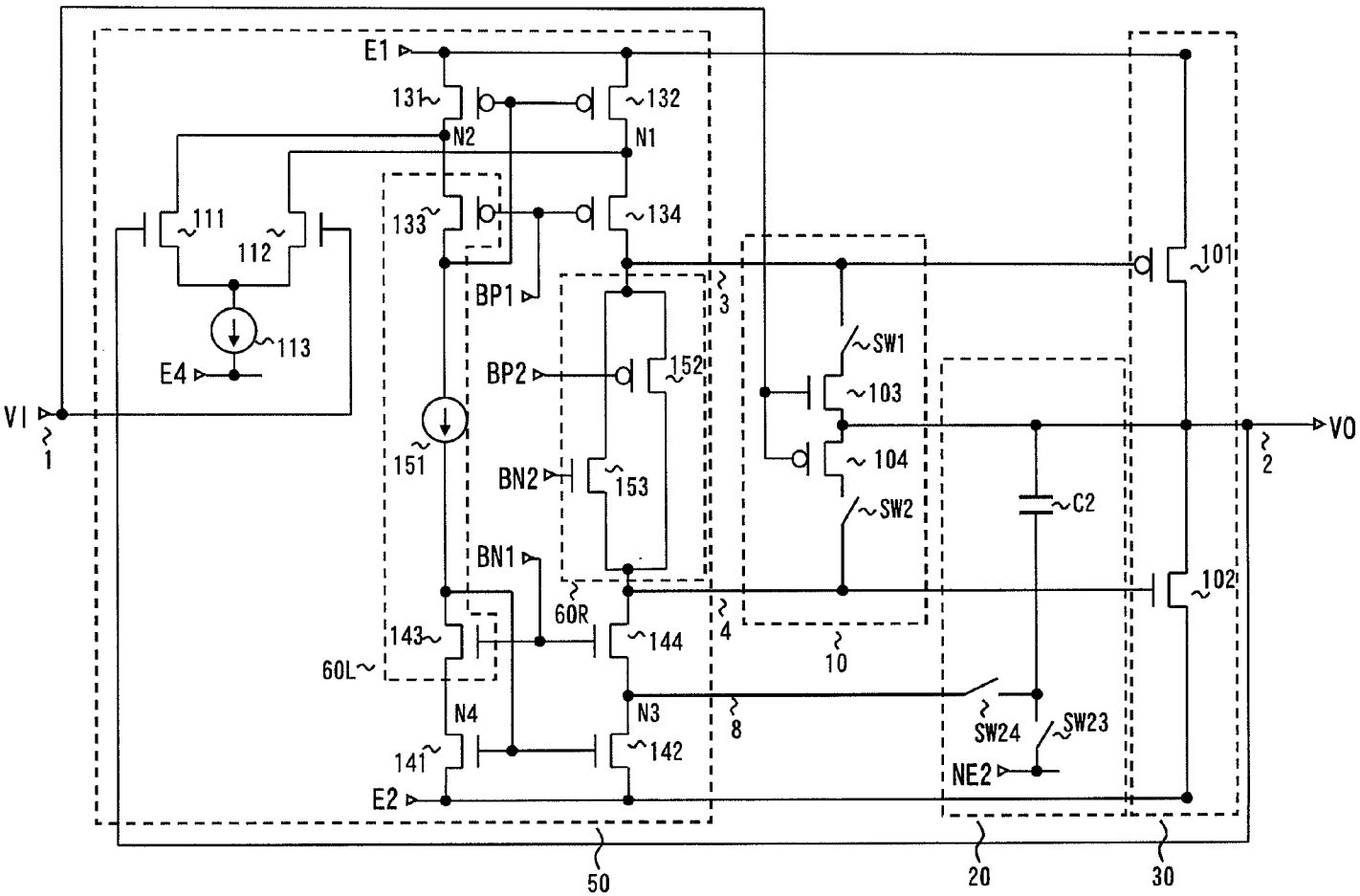
FIG. 20 is a circuit diagram showing a configuration of Example 4 of the present invention.

An Example 4 of the present invention will now be described with reference to FIG. 20 showing its configuration. In FIG. 20, the differential amplifier stage 50 is the same as that of FIG. 19. The capacitance connection control circuit 20 of FIG. 20 is constituted by a capacitive element C2, a voltage supply terminal NE2 and switches SW23 and SW24.

In the capacitance connection control circuit 20 of FIG. 20, when the switches SW23 and SW24 are off and on, respectively, and the capacitive element C2 is connected between the node 8 and the output terminal 2, and one of the Nch differential pair transistors (112, 111) is turned on, with the other being turned off, the output voltage VO is varied at a constant slew rate. At this time, the slew rate of the output voltage VO is given by the following expression (5):

$$dVO/dt \approx I1/C2 \quad (5)$$

The expression is derived by setting I2 and C1 to zero in the relationship (3) explained in connection with the related technology (FIG. 18).

In case the power supply E3 of the differential amplifier stage 50 of FIG. 20 may be made higher than the power supply E1, the output circuit may have an operation range which is the same as that of the output circuit of FIG. 9 (the voltage range from power supply E1 to the power supply E2).

The differential amplifier stage 50 as well as the capacitance connection control circuit 20 in FIG. 20 may be replaced by the differential amplifier stage 50 as well as capacitance connection control circuit 20 of each of the exemplary embodiments of FIGS. 1, 2 and 6 to 8. By the operation of the amplification acceleration circuit 10 and the capacitance connection control circuit 20, explained in the exemplary embodiments, the wiring load may be driven at an elevated speed.

Example 5

Figure 11:
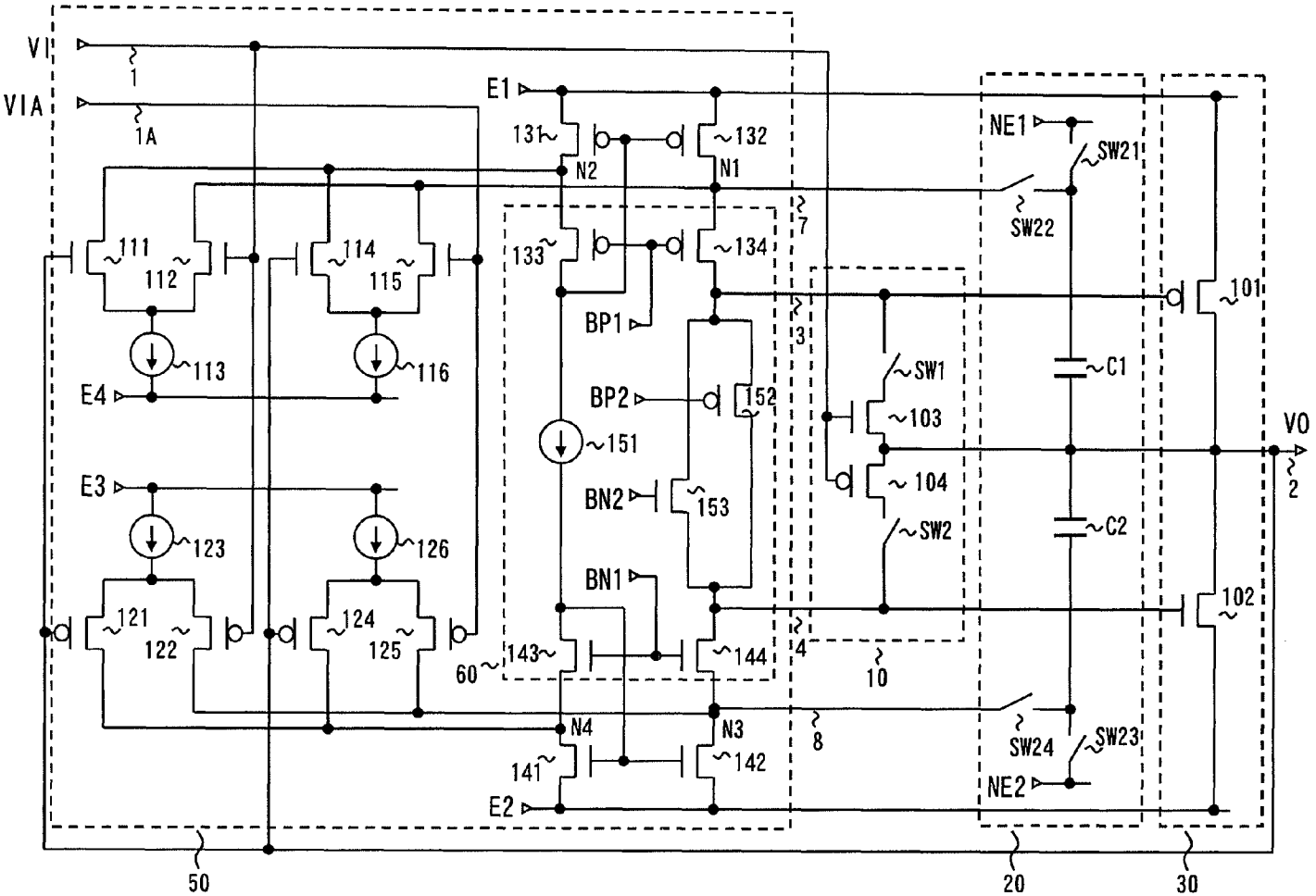
FIG. 11 is a circuit diagram showing a configuration of Example 5 of the present invention.

An Example 5 of the present invention will now be described. FIG. 11 shows a configuration of Example 5 of the present invention. In the present Example, the differential amplifier stage 50 of FIG. 11 includes two sets of interpolation type differential amplifiers, each set made up of a plurality of differential pair transistors of the same conductivity type in FIG. 9. Each two of Nch differential pairs and Pch differential pairs make up the differential amplifier stage of FIG. 11 as a typical example. Referring to FIG. 11, Nch differential pair transistors 112 and 111, which are driven by a current source 113 and differentially receive VI and VO, and Nch differential pair transistors 115 and 114, which are driven by a current source 116 and differentially receive VIA and VO, are shown. The drains of the Nch transistors 111 and 114 are connected to the drains of the Pch transistor 131, while the drains of the Nch transistors 112 and 115 are connected to the drain of the Pch transistor 132 (node 7). Pch differential pair transistors (122, 121), which are driven by a current source 123 and differentially receive VI and VO, and Pch differential pair transistors (125, 124), which are driven by a current source 126 and differentially receive VIA and VO, are shown. The drains of the Pch transistors 121 and 124 are connected to the drains of the Pch transistor 141, while the drains of the transistors 122 and 125 are connected to the drain of the transistor 142 (node 8).

In case pair transistors of two differential pairs of the same polarity are of the same size, and the current values of the current sources driving them are equal, the output voltage VO at the output terminal 2 is of a voltage value that internally divides the two input voltages VI and VIA by 1:1, that is, VO=(VI+VIA)/2.

An input of the amplification acceleration circuit 10 is connected to one of inputs of a plurality of differential pairs (input terminal 1 in FIG. 11). When the input voltages VI and VIA are changed appreciably, the amplification acceleration circuit 10 causes the output voltage VO to be changed rapidly towards the vicinity of the input voltage VI of the input terminal 1. In case the two input voltages VI and VIA are relatively close to each other, the input voltage VI and the ultimate target voltage value of the output voltage VO are also close to each other. It is thus possible to achieve high speed driving of the output voltage VO towards the ultimate target voltage value, as in FIG. 9.

The differential amplifier stage 50 of FIG. 11 may be replaced by a differential amplifier stage 50 of any of output circuits of the exemplary embodiments shown in FIGS. 1, 3 and 6 to 8.

Example 6

Figure 12:
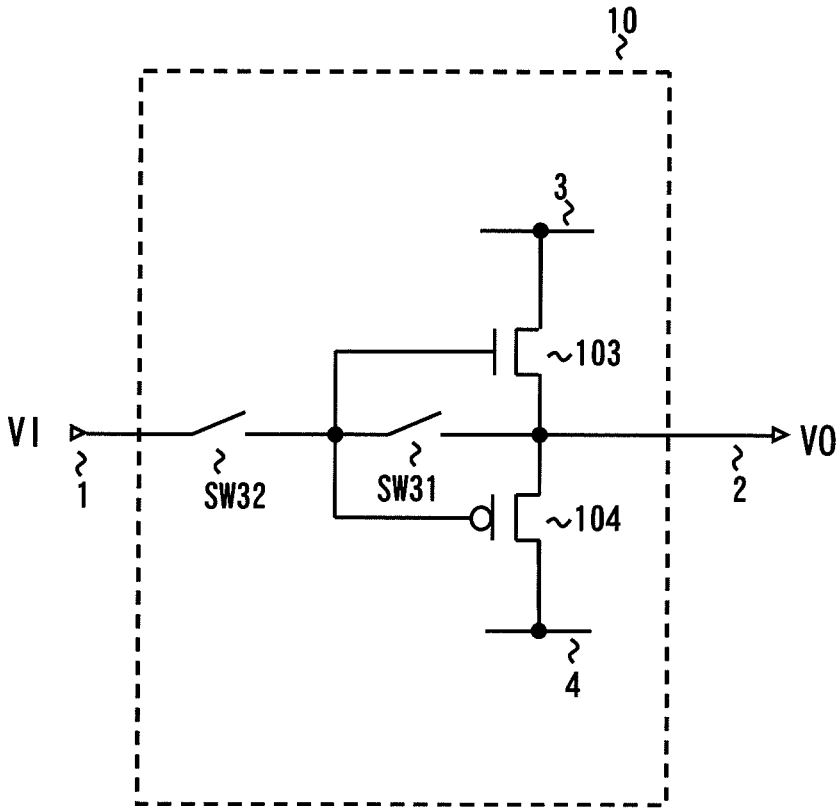
FIG. 12 is a circuit diagram showing another configuration of an amplification acceleration circuit.

Example 6 of the present invention will now be described with respect to FIG. 12 showing its configuration. In the present Example, the configuration of the amplification acceleration circuit 10 has been modified. More specifically, in place of the switches SW1 and SW2 in the amplification acceleration circuit 10 of the exemplary embodiment shown e.g., in FIG. 1, there may be provided a switch SW31 between common gates of the transistors 103 and 104 and the output terminal 2 (commonly coupled sources of the transistors 103 and 104) and a switch SW32 that disconnects a path between the input terminal 1 and the output terminal 2 when the switch SW31 is turned on and the transistors 103 and 104 are deactivated.

In FIG. 12, the on/off of the switch SW31 is controlled, in a reverse relationship, or complementarily, to that of the switches SW1 and SW2 of FIG. 1. When the switches SW1 and SW2 are turned on, the switch SW31 is turned off and vice versa. The on/off of the switch SW32 may be controlled in the same way as that of the switches SW1 and SW2 of FIG. 1. When the switches SW1 and SW2 are turned on, the switch SW32 is turned on and when the switches SW1 and SW2 are off, the switch SW32 is off.

In the configuration of FIG. 12, the switch SW32 is connected between the input terminal and the commonly coupled gates of output stage transistor 103 and 104, but not limited to such a configuration. For example, the switch SW32 may be connected between the commonly coupled drains of output stage transistor 103 and 104 and the output terminal 2.

In the configuration of FIG. 12, the switches SW31 and SW32 need to be designed as COMS switch (complementary switch made up of a Pch transistor and an Nch transistor), depending on the voltage range of the input voltage VI.

Example 7

Figure 13:
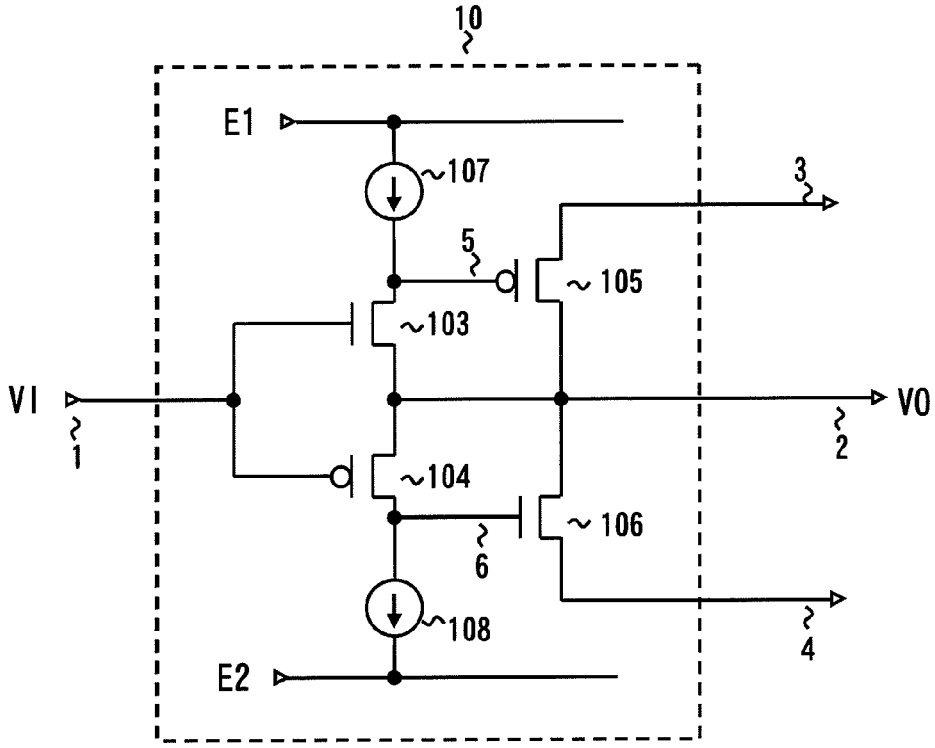
FIG. 13 is a circuit diagram showing yet another configuration of an amplification acceleration circuit.

An Example 7 of the present invention will now be described with respect to FIG. 13 showing its configuration and specifically showing another modification of the amplification acceleration circuit 10. The same configuration as that of the control circuit 90 of the related technology of FIG. 16 may be used in the circuit configuration shown in FIG. 13. The following describes an variation example of an output circuit which has a configuration shown in FIG. 1, but the amplification acceleration circuit 10 of FIG. 1 is replaced by the amplification acceleration circuit 10 of FIG. 13. As with FIG. 2, one output period for outputting an output voltage in accordance with an input voltage, includes periods T1 and T2 in the same manner as with FIG. 2. The switches SW21 and SW23 are turned on and the switches SW22 and SW24 are turned off in the period T1 in one output period, and then the switches SW21 and SW23 are turned off and the switches SW22 and SW24 are turned on in the period T2 following T1. In the period T1, the amplification acceleration circuit 10 of FIG. 13 operates to change a voltage of a gate of the transistor 101 or 102 in accordance with the potential difference between the input voltage and output voltage and to cause the output voltage to approach quickly. At the same time, charging or discharging of the capacitance elements C1 and C2 in accordance with the change of the input voltage are performed. The amplification acceleration circuit 10 of FIG. 13 ceases to operate when the output voltage is close to the input voltage. In the period T2, the output terminal 2 is driven by the differential amplifier under a normal operation, in which the amplification acceleration circuit 10 of FIG. 13 is kept to cease its operation. Therefore, in the output circuit according to this variation, it is also possible to perform fast driving of the output terminal 2 as with the output circuit of FIG. 1.

Example 8

Figure 14:
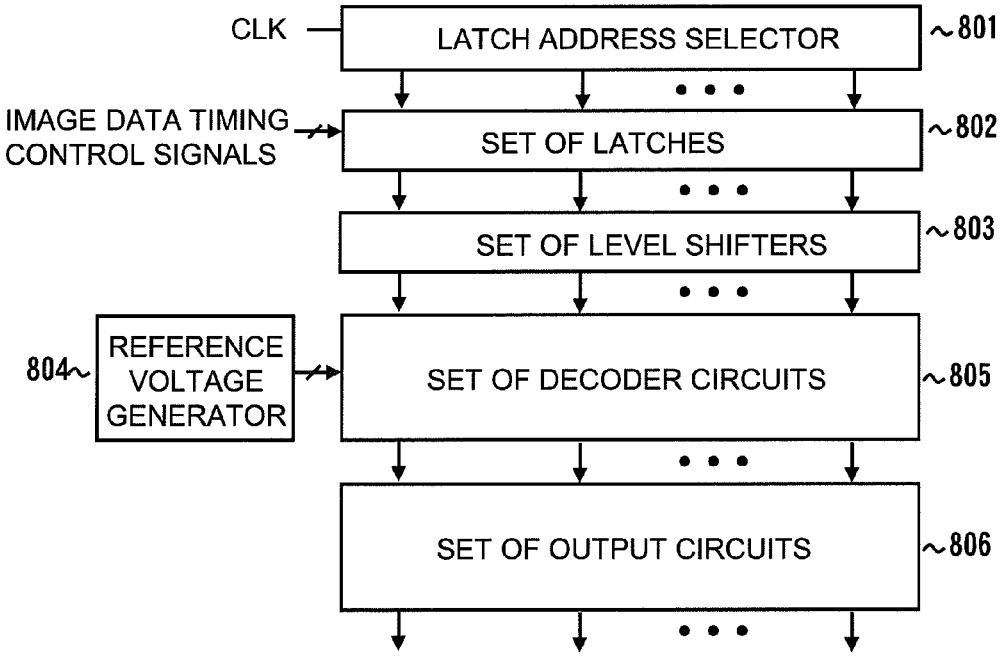
FIG. 14 is a diagram showing a configuration of a data driver provided with the output circuit of the present invention.
Figure 15A:
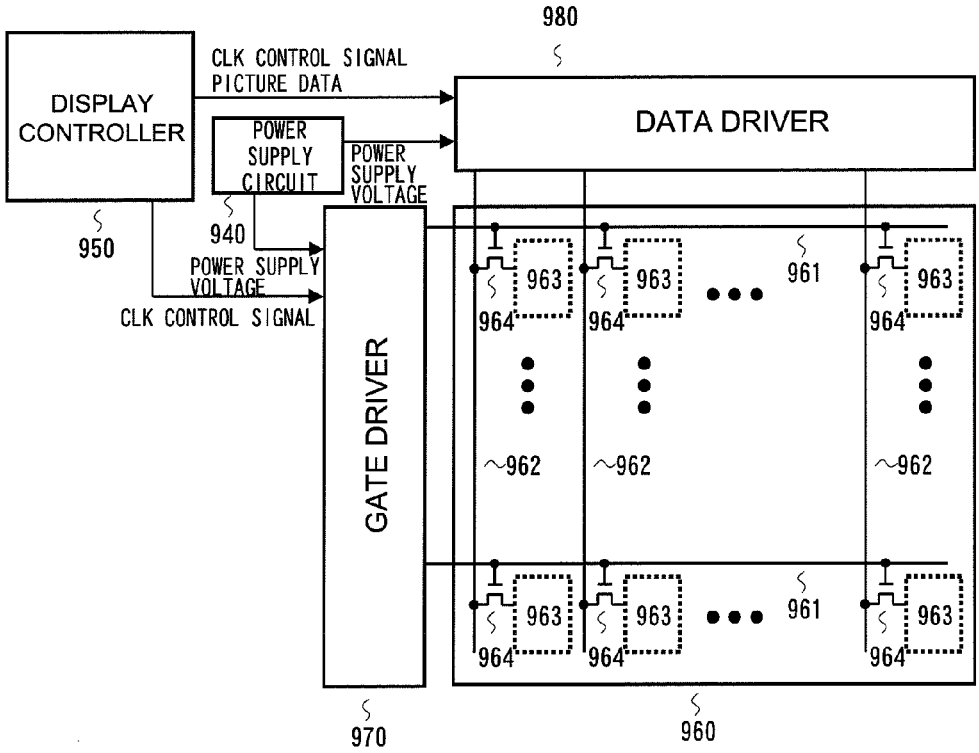
FIG. 15A is a diagram for illustrating a display device and FIGS. 15B and 15C are circuit diagrams for illustrating a pixel (a liquid crystal element and an organic EL element).
Figure 15B:
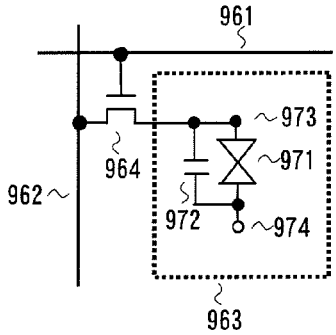
Figure 15C:
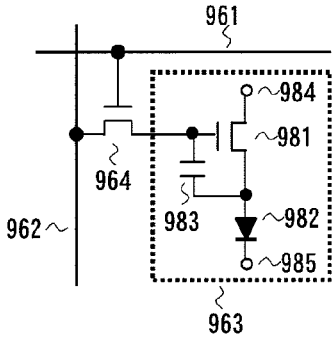

An Example 8 of the present invention will now be described with reference to FIG. 14 showing essential portions of the configuration of a data driver of a display device of Example 8 of the present invention. Referring to FIG. 14, the data driver includes a reference voltage generator 804, a set of decoder circuits 805, a set of output circuits 806, a latch address selector 801, a set of latches 802 and a set of level shifters 803. As each of the output circuits 806, the output circuit of the exemplary embodiment and Examples described with reference to FIGS. 1, 3, 6 to 11, 19 and 20 may be used. The output circuits provided is in correspondence with the number of outputs.

The latch address selector 801 determines the data latch timing based on the clock signal CLK. The latches 802 each latches digital image data based on the timing determined by the latch address selector 801. Digital data signals are supplied to decoder circuits 805, via level shifters 803, substantially in unison in response to a STB (strobe) signal (not shown in FIG. 14) which is one of the timing control signals. The decoder circuits 805 each selects a preset number of reference voltages generated by the reference voltage generator 804, in accordance with the input digital data signal. The output circuits 806 each receives a preset number of the reference voltages selected by a corresponding one of the decoder circuits 805, and amplifies an output voltage corresponding to the received reference voltages to output the so amplified output voltage. Output terminals of the output circuits 806 are connected to data lines of the display device. The latch address selector 801 and the latches 802 are logic circuits normally designed to be operated with a low voltage, such as between 0V and 3.3V, and are supplied with a corresponding power supply voltage. The level shifters 803, the decoder circuits 805 and the output circuits 806 are usually designed to be operated with a high voltage necessary for driving the display elements, such as between 0V and 18V, and are supplied with a corresponding power supply voltage.

For the reference voltage generator 804, such a configuration is usually employed in which reference voltages are generated by resistance division in which a plurality of resistance elements which are connected in series and have both ends connected to first and second power supplies, and in which reference voltages are output from the connection nodes (taps) of the resistance elements. Though not limited thereto, the decoder circuits 805 each may have, for example, a tournament type configuration in which one of two reference voltages is sequentially selected by a bit signal of the digital data signal.

The impedances of the reference voltage generators 804, supplying the voltages to the output circuits 806, and the decoders corresponding to the respective outputs, are relatively high. It is thus required of the output circuits 806 to have a sufficiently small input capacitance to drive data lines at an elevated speed.

The output circuits of the exemplary embodiments and Examples, explained with respect to FIGS. 1, 3, 6 to 11, 19 and 20 are of sufficiently small input capacitance and hence may conveniently be used as the output circuits of the set of the output circuits 806.

With the present Examples, there may be provided such a data driver or a display device that may allow for high speed driving with low power consumption.

The disclosures of the aforementioned Patent Documents are to be incorporated by reference herein. The particular exemplary embodiments or examples may be modified or adjusted within the gamut of the entire disclosure of the present invention, inclusive of claims, based on the fundamental technical concept of the invention. Further, variegated combinations or selection of elements disclosed herein may be made within the framework of the claims. That is, the present invention may encompass various modifications or corrections that may occur to those skilled in the art within the gamut of the entire disclosure of the present invention, inclusive of claim and the technical concept of the present invention.

What is claimed is:

1. An output circuit comprising:

an input terminal supplied with an input signal;

an output terminal that outputs an output signal;

a first power supply terminal supplied with a first power supply voltage;

a second power supply terminal supplied with a second power supply voltage;

a first voltage supply terminal supplied with a first voltage;

a differential amplification stage;

an output amplification stage;

an amplification acceleration circuit; and a capacitance connection control circuit, wherein said output amplification stage includes:

a first transistor of a first conductivity type having first and second terminals connected to said first power supply terminal and said output terminal, respectively, and having a control terminal connected to a first output of said differential amplifier stage; and a second transistor of a second conductivity type having first and second terminals connected to said second power supply terminal and said output terminal, respectively, and having a control terminal connected to a second output of said differential amplifier stage, wherein said amplification acceleration circuit includes:

first and second switches;

a third transistor of said second conductivity type connected in series with said first switch between said output terminal and said first output of said differential amplifier stage, said third transistor having a control terminal connected to said input terminal; and a fourth transistor of said first conductivity type connected in series with said second switch between said output terminal and said second output of said differential amplifier stage, said fourth transistor having a control terminal connected to said input terminal, wherein said differential amplifier stage includes:

first differential pair transistors of said second conductivity type having first terminals coupled together, having second terminals connected to a first node and a second node, respectively, and having control terminals connected to said input terminal and said output terminal, respectively;

a first current source connected between said coupled first terminals of said first differential pair transistors and said second power supply terminal;

first pair transistors of said first conductivity type having first terminals connected in common to said first power supply terminal, having second terminals connected to said first and second nodes, respectively, and having control terminals coupled together;

second pair transistors of said second conductivity type having first terminals connected in common to said second power supply terminal, and having second terminals connected to a third node and a fourth node, respectively, and having control terminals coupled together;

a fifth transistor of said first conductivity type having a first terminal connected to said first node, having a second terminal connected to said first output of said differential amplifier stage, and having a control terminal supplied with a first bias voltage;

a sixth transistor of said second conductivity type having a first terminal connected to said third node, having a second terminal connected to said second output of said differential amplifier stage, and having a control terminal supplied with a second bias voltage;

a first connection circuit connected between said second node and said fourth node; and a second connection circuit connected between said first output and said second output of said differential amplifier stage, and wherein said capacitance connection control circuit includes:

a first capacitive element having a first terminal connected to said output terminal;

a third switch connected between said first voltage supply terminal and a second terminal of said first capacitive element; and a fourth switch connected between said second terminal of said first capacitive element and one of said first and third nodes.

2. The output circuit according to claim 1, further comprising a second voltage supply terminal supplied with a second voltage; wherein said differential amplifier stage further includes:

second differential pair transistors of said first conductivity type having first terminals coupled together, having second terminals connected to said third node and said fourth node, respectively, and having control terminals connected to said input terminal and said output terminal, respectively;

a second current source connected between said coupled first terminals of said second differential pair transistors and said first power supply terminal, and wherein said capacitance connection control circuit further includes:

a second capacitive element having a first terminal connected to said output terminal;

a fifth switch connected between a second terminal of said second capacitive element and said second voltage supply terminal; and a sixth switch connected between said second terminal of said second capacitive element and the other of said first and third nodes.

3. The output circuit according to claim 1, wherein said first connection circuit includes:

a seventh transistor of said first conductivity type having a first terminal connected to said second node, having a second terminal connected to said control terminals of said first pair transistor and having a control terminal connected to said control terminal of said fifth transistor;

an eighth transistor of said second conductivity having a first terminal connected to said fourth node, having a second terminal connected to said control terminals of said second pair transistors and having a control terminal connected to said control terminal of said sixth transistor; and a second current source connected between said second terminal of said seventh transistor and said second terminal of said eighth transistor, and wherein said second connection circuit includes:

a ninth transistor of said first conductivity type having first and second terminals connected to said first and said second outputs of said differential amplifier stage, respectively and having a control terminal supplied with a third bias voltage; and a tenth transistor of said second conductivity type having second and first terminals respectively connected to said first and second outputs of said differential amplifier stage, respectively, and having a control terminal supplied with a fourth bias voltage.

4. The output circuit according to claim 1, wherein said first connection circuit includes:

a second current source connected between said second node and said fourth node, wherein said second connection circuit includes:

a seventh transistor of said first conductivity type having first and second terminals connected respectively to said first and second outputs of said differential amplifier stage, and having a control terminal supplied with a third bias voltage; and a eighth transistor of said second conductivity type having second and first terminals connected respectively to said first and second outputs of said differential amplifier stage, and having a control terminal receiving a fourth bias voltage.

5. The output circuit according to claim 1, wherein in said capacitance connection control circuit, during a predetermined first period following a start of an output period of outputting said output signal in accordance with said input signal from said output terminal, said third switch is turned on, said fourth switch is turned off and said second terminal of said first capacitive element is connected to said first voltage supply terminal, after said first period within said output period, said third switch is turned off, said fourth switch is turned on, and said second terminal of said first capacitive element is connected to said one of said first and third nodes.

6. The output circuit according to claim 2, wherein in said capacitance connection control circuit, during a first period following a start of an output period of outputting said output signal in accordance with said input signal from said output terminal, said fifth switch is turned on, said sixth switch is turned off and said second terminal of said second capacitive element is connected to said second voltage supplying terminal, after said first period within said output period, said fifth switch is turned off, said sixth switch is turned on and said second terminal of said second capacitive element is connected to said other of said first and third nodes.

7. The output circuit according to claim 2, wherein in said capacitance connection control circuit, said one of said first and third nodes is set as said first node, said second terminal of said first capacitive element is connected via said fourth switch to said first node, said other node out of said first and third nodes is set as said third node; said second terminal of said second capacitive element is connected via said sixth switch to said third node, during a predetermined first period following a start of an output period of outputting said output signal in accordance with said input signal from said output terminal, said third and fifth switches are turned on, said fourth and sixth switches are turned off, and said second terminals of said first and second capacitive elements are connected to said first and second voltage supplying terminals, respectively, after said first period within said output period, said third and fifth switches are turned off, said fourth and sixth switches are turned on, and said second terminals of said first and second capacitive elements are connected to said first and third nodes of said differential amplifier stage, respectively.

8. The output circuit according to claim 5, further comprising an output switch having a first end connected to said output terminal and having a second end connected to a load, said output switch being turned off during a second period including said first period within said output period, said output switch being turned on following said second period within said output period.

9. The output circuit according to claim 5, wherein in said amplification acceleration circuit, said first and second switches are turned on in said first period within said output period, and said first and second switches are turned off after said first period within said output period.

10. The output circuit according to claim 1, wherein said output amplifier stage includes:

a seventh transistor of said first conductivity type having first and second terminals connected to said first power supply terminal and said output terminal, respectively;

an eighth transistor of said second conductivity type having first and second terminals connected to said second power supply terminal and said output terminal, respectively;

a fifth switch connected between a control terminal of said seventh transistor and said first power supply terminal;

a sixth switch connected between a control terminal of said seventh transistor and said first output of said differential amplifier stage;

a seventh switch connected between a control terminal of said eighth transistor and said second power supply terminal; and an eighth switch connected between the control terminal of said eighth transistor and said second output terminal of said differential amplifier stage.

11. The output circuit according to claim 10, wherein during a predetermined first period following a start of said output period of outputting said output signal in accordance with said input signal from said output terminal, said fifth and seventh switches are turned on and said sixth and eighth switches are turned off, after said first period within said output period, said fifth and seventh switches are turned off and said sixth and eighth switches are turned on.

12. The output circuit according to claim 8, wherein said output amplifier stage further includes:

an seventh transistor of said second conductivity type having second and first terminals connected respectively to said first power supply terminal and said second end of said output switch, and having a control terminal connected to a connection node at which said first end of said output switch and said output terminal are connected; and an eighth transistor of said first conductivity type having second and first terminals connected respectively to said second power supply and said second end of said output switch and having a control terminal connected to a connection node at which said first end of said output switch and said output terminal are connected.

13. The output circuit according to claim 2, further comprising:

a second input terminal, wherein said differential amplifier stage includes third differential pair transistors of said second conductivity type having first terminals coupled together, having control terminals connected to said second input terminal and said output terminal, respectively, having second terminals connected to said second terminals of said first differential pair transistors, respectively and connected to said first and second nodes, respectively; and a third current source arranged between said coupled first terminals of said third differential pair transistors and said second power supply terminal;

fourth differential pair transistors of said first conductivity type having first terminals coupled together, having control terminals connected to said second input terminal and said output terminal, respectively; and having second terminals connected to said second terminals of said second differential pair transistors, respectively and connected to said third and fourth nodes, respectively, a fourth current source arranged between said coupled first terminals of said fourth differential pair transistors and said second power supply terminal, said fourth differential pair transistors having second terminals connected to said second terminals of said second differential pair transistors at said third and fourth nodes.

14. An output circuit comprising:

an input terminal supplied with an input signal;

an output terminal that outputs an output signal;

a first power supply terminal supplied with a first power supply voltage;

a second power supply terminal supplied with a second power supply voltage;

a first voltage supply terminal supplied with a first voltage;

a differential amplification stage;

an output amplification stage;

an amplification acceleration circuit; and a capacitance connection control circuit, wherein said output amplification stage includes:

a first transistor of a first conductivity type having first and second terminals connected to said first power supply terminal and said output terminal, respectively, and having a control terminal connected to a first output of said differential amplifier stage; and a second transistor of a second conductivity type having first and second terminals connected to said second power supply terminal and said output terminal, respectively, and having a control terminal connected to a second output of said differential amplifier stage, wherein said amplification acceleration circuit includes:

first and second switches;

a third transistor of said second conductivity type; and a fourth transistor of said first conductivity type, said third transistor and said fourth transistor having first terminals connected together, having control terminals connected together, having second terminals connected to said first output and said second output of said differential amplifier stage, respectively, said first switch arranged between a connection node of said first terminals of said third and fourth transistors and a connection node of said control terminals of said third and fourth transistors, said second switch arranged between a connection node of said control terminals of said third and fourth transistors and said input terminal, with said connection node of said first terminals of said third and fourth transistors connected to said output terminal, or arranged between a connection node of said first terminals of said third and fourth transistors and said output terminal, with said connection node of said control terminals of said third and said fourth transistors connected to said input terminal; wherein said differential amplifier stage includes:

first differential pair transistors of said second conductivity type having first terminals coupled together, having second terminals connected to a first node and a second node, respectively, and having control terminals connected to said input terminal and said output terminal, respectively;

a first current source connected between said coupled first terminals of said first differential pair transistors and said second power supply terminal;

first pair transistors of said first conductivity type having first terminals connected in common to said first power supply terminal, having second terminals connected to said first and second nodes, respectively, and having control terminals coupled together;

second pair transistors of said second conductivity type having first terminals connected in common to said second power supply terminal, and having second terminals connected to a third node and a fourth node, respectively, and having control terminals coupled together;

a fifth transistor of said first conductivity type having a first terminal connected to said first node, having a second terminal connected to said first output of said differential amplifier stage, and having a control terminal supplied with a first bias voltage;

a sixth transistor of said second conductivity type having a first terminal connected to said third node, having a second terminal connected to said second output of said differential amplifier stage, and having a control terminal supplied with a second bias voltage;

a first connection circuit connected between said second node and said fourth node; and a second connection circuit connected between said first output and said second output of said differential amplifier stage, and wherein said capacitance connection control circuit includes:

a first capacitive element having a first terminal connected to said output terminal;

a third switch connected between said first voltage supply terminal and a second terminal of said first capacitive element; and a fourth switch connected between said second terminal of said first capacitive element and one of said first and third nodes.

15. An output circuit comprising:

an input terminal supplied with an input signal;

an output terminal that outputs an output signal;

a first power supply terminal supplied with a first power supply voltage;

a second power supply terminal supplied with a second power supply voltage;

a first voltage supply terminal supplied with a first voltage;

a differential amplification stage;

an output amplification stage;

an amplification acceleration circuit; and a capacitance connection control circuit, wherein said output amplification stage includes:

a first transistor of a first conductivity type having first and second terminals connected to said first power supply terminal and said output terminal, respectively, and having a control terminal connected to a first output of said differential amplifier stage; and a second transistor of a second conductivity type having first and second terminals connected to said second power supply terminal and said output terminal, respectively, and having a control terminal connected to a second output of said differential amplifier stage, wherein said amplification acceleration circuit includes:

a first current source having a first end connected to said first power supply terminal;

a third transistor of said second conductivity type having a first terminal connected to said output terminal, having a second terminal connected to a second end of said first current source, and having a control terminal connected to said input terminal;

a second current source having a first end connected to said second power supply terminal;

a fourth transistor of said first conductivity type having a first terminal connected to said output terminal, having a second terminal connected to a second end of said second current source, and having a control terminal connected to said input terminal;

a fifth transistor of said first conductivity type having a second terminal connected to said output terminal, having a first terminal connected to said first output of said differential amplifier stage, and having a control terminal connected to a connection node at which said third transistor and said second end of said first current source are connected; and a sixth transistor of said second conductivity type having a second terminal connected to said output terminal, having a first terminal connected to said second output of said differential amplifier stage, and having a control terminal connected to a connection node at which said fourth transistor and said second end of said second current source are connected, wherein said differential amplifier stage includes:

first differential pair transistors of said second conductivity type having first terminals coupled together, having second terminals connected to a first node and a second node, respectively, and having control terminals connected to said input terminal and said output terminal, respectively;

a third current source connected between said coupled first terminals of said first differential pair and said second power supply terminal;

first pair transistors of said first conductivity type having first terminals connected in common to said first power supply terminal, having second terminals connected to said first and second nodes, respectively, and having control terminals coupled together;

second pair transistors of said second conductivity type having first terminals connected in common to said second power supply terminal, and having second terminals connected to a third node and a fourth node, respectively, and having control terminals coupled together;

a seventh transistor of said first conductivity type having a first terminal connected to said first node, having a second terminal connected to said first output of said differential amplifier stage, and having a control terminal supplied with a first bias voltage;

a eighth transistor of said second conductivity type having a first terminal connected to said third node, having a second terminal connected to said second output of said differential amplifier stage, and having a control terminal supplied with a second bias voltage;

a first connection circuit connected between said second node and said fourth node; and a second connection circuit connected between said first output and said second output of said differential amplifier stage, and wherein said capacitance connection control circuit includes:

a first capacitive element having a first terminal connected to said output terminal;

a first switch connected between said first voltage supply terminal and a second terminal of said first capacitive element; and a second switch connected between said second terminal of said first capacitive element and one of said first and third nodes.

16. A data driver apparatus including:

a decoder that selects and outputs at least one of a plurality of reference voltages, in accordance with a digital image signal received; and the output circuit according to claim 1, said output circuit having an input terminal that receives an output of said decoder, said output circuit driving a data line connected to a plurality of display elements.

17. A data driver apparatus including:

a decoder that selects and outputs at least one of a plurality of reference voltages, in accordance with a digital image signal received; and the output circuit according to claim 14, said output circuit having an input terminal that receives an output of said decoder, said output circuit driving a data line connected to a plurality of display elements.

18. A data driver apparatus including:

a decoder that selects and outputs at least one of a plurality of reference voltages, in accordance with a digital image signal received; and the output circuit according to claim 15, said output circuit having an input terminal that receives an output of said decoder, said output circuit driving a data line connected to a plurality of display elements.

19. A display device including the data driver apparatus according to claim 16.

20. A display device including the data driver apparatus according to claim 17.

* * * * *

UNITED STATES PATENT AND TRADEMARK OFFICE

CERTIFICATE OF CORRECTION

PATENT NO. : 8,686,987 B2
APPLICATION NO. : 13/029888
DATED : April 1, 2014
INVENTOR(S) : Hiroshi Tsuchi It is certified that error appears in the above-identified patent and that said Letters Patent is hereby corrected as shown below:

In the Specification

Column 33, Line 26: Delete "13" and insert -- I3 --.

Column 33, Line 27: Delete "14." and insert -- I4 --.

Signed and Sealed this
Twenty-first Day of October, 2014

Michelle K. Lee

Michelle K. Lee
*Deputy Director of the United States Patent and Trademark Office*